US005810077A

United States Patent [19]

Nakamura et al.

[11] Patent Number: 5,810,077

[45] Date of Patent: Sep. 22, 1998

[54] LAYERED HEAT EXCHANGER

[75] Inventors: Jumpei Nakamura; Hiroki Shibata, both of Oyama; Keiji Yamazaki, Kawachi-gun; Tatsuya Hanafusa; Nobuaki Go, both of Oyama, all of Japan

[73] Assignee: Showa Aluminum Corporation, Osaka, Japan

[21] Appl. No.: 803,264

[22] Filed: Feb. 20, 1997

Related U.S. Application Data

[63] Continuation of Ser. No. 365,463, Dec. 28, 1994, abandoned.

[30] Foreign Application Priority Data

| | | | |
|---|---|---|---|
| Dec. 28, 1993 | [JP] | Japan | 5-337439 |
| May 25, 1994 | [JP] | Japan | 6-110890 |
| Aug. 17, 1994 | [JP] | Japan | 6-193190 |
| Sep. 28, 1994 | [JP] | Japan | 6-233248 |

[51] Int. Cl.[6] ..... F28D 1/03

[52] U.S. Cl. ..... 165/153; 165/126

[58] Field of Search ..... 165/153, 176; 62/515

[56] References Cited

U.S. PATENT DOCUMENTS

| | | | |
|---|---|---|---|
| 4,371,034 | 2/1983 | Yamada et al. . | |
| 5,062,477 | 11/1991 | Kadle | 165/174 |
| 5,111,878 | 5/1992 | Kadle | 165/176 |
| 5,125,453 | 6/1992 | Bertrand et al. | 165/153 |
| 5,137,082 | 8/1992 | Shimoya et al. | 165/153 X |
| 5,417,280 | 5/1995 | Hayashi et al. | 165/153 |
| 5,447,194 | 9/1995 | Hayashi et al. | 165/153 X |

FOREIGN PATENT DOCUMENTS

| | | | |
|---|---|---|---|
| 0 415 584 | 3/1991 | European Pat. Off. . | |
| 813272 | 11/1936 | France . | |
| 87792 | 4/1987 | Japan | 165/153 |
| 90992 | 4/1989 | Japan | 165/153 |
| 87595 | 4/1991 | Japan | 165/153 |
| 155191 | 5/1992 | Japan | 165/153 |
| 172485 | 7/1993 | Japan | 165/153 |
| 332697 | 12/1993 | Japan | 165/153 |

*Primary Examiner*—Leonard R. Leo
*Attorney, Agent, or Firm*—Armstrong, Westerman, Hattori, McLeland & Naughton

[57] ABSTRACT

A layered heat exchanger for use as a motor vehicle air conditioner evaporator comprises pairs of generally rectangular adjacent plates, which are joined together in layers with the corresponding recesses of the plates in each pair opposed to each other to thereby form juxtaposed flat tubes each having a U-shaped fluid channel, and front and rear headers in communication respectively with opposite ends of each flat tube. The turn portion of U-shaped fluid channel of the flat tube has a fluid mixing portion comprising many small projections, and a rectifying portion comprising parallel long projections along a flow of fluid. The channel turn portion rectifies the flow of fluid and mixes the fluid at the same time, permitting the fluid to flow through the turn portion smoothly to result in a diminished fluid pressure loss, an improved heat transfer coefficient and improved performance.

6 Claims, 17 Drawing Sheets

LAYERED HEAT EXCHANGER

This application is a continuation of application Ser. No. 08/356,463 filed Dec. 28, 1994, now abandoned.

BACKGROUND OF THE INVENTION

The present invention relates to layered heat exchangers useful as evaporators for motor vehicle air conditioners Already known as such layered heat exchangers are two types; those having headers at one of the upper and lower sides of an assembly of plates in layers, and those having headers at these sides, respectively. Those of the former type have a heat exchange portion which is greater than in the latter type and are therefore expected to exhibit improved performance.

Stated more specifically, layered heat exchangers having the headers at one side comprise pairs of generally rectangular adjacent plates, each of the plates being formed in one side thereof with a U-shaped channel recess and a pair of header recesses continuous respectively with one end and the other end of the channel recess and each having a fluid passing opening, the plates being joined together in layers with the corresponding recesses of the plates in each pair opposed to each other to thereby form juxtaposed flat tubes each having a U-shaped fluid channel, and front and rear headers communicating respectively with opposite ends of each flat tube for causing a fluid to flow through all the flat tubes and the headers.

However, the conventional layered heat exchanger having the headers at one side has the problem that when used as an evaporator for motor vehicle air conditioners, the refrigerant fails to flow smoothly along the turn portion of U-shaped channel recess of each plate and to achieve as high an efficiency as is expected. This is because if the plates are designed, for example, to produce a rectifying affect, the refrigerant flow pressure loss can be diminished, but a reduced heat transfer coefficient and therefore an impaired heat exchange efficiency will result, whereas if the plates are conversely adapted to give a mixing effect chiefly, the refrigerant flow pressure loss increases to an undesirable level despite an improved heat transfer coefficient. The refrigerant is then liable to stagnate or flow unevenly especially in the vicinity of U-shaped turn portion of the refrigerant channel of each flat tube, consequently permitting the evaporator to exhibit impaired performance.

Further with the conventional evaporator, the joint between the plates is made by point contact, which therefore entails the problem that it is difficult to ensure pressure resistant strength.

SUMMARY OF THE INVENTION

The present invention provides a layered heat exchanger which is free of the foregoing problems.

The invention provides a layered heat exchanger wherein the headers are disposed at one side and which is characterized in that the U-shaped recess of each plate has a turn portion provided with a fluid mixing portion having a multiplicity of small projections and a rectifying portion having parallel long projections, the plates in each pair being joined to each other with their recesses opposed to each other to provide a fluid mixing portion and a rectifying portion in a channel turn portion of U-shaped fluid channel of the resulting flat tube.

The turn portion of U-shaped channel forming recess of each plate is provided with a fluid mixing portion at its central part and a rectifying portion at each of front and rear sides of the mixing portion. Alternatively, the rectifying portion is provided at the central part of the turn portion, and the fluid mixing portion at each of front and rear sides of the rectifying portion.

In the former case wherein the rectifying portion is provided at each of front and rear parts of the channel forming recess of the plate, the parallel long projections are, for example, generally L-shaped, have inward horizontal portions and are larger in size when positioned closer to the outside. Accordingly, the fluid rapidly flows through the turn portion and is thoroughly mixed in the central part where the multiplicity of small projections are formed to provide the mixing portion.

In the latter case wherein the rectifying portion is provided in the central part of the turn portion, the rectifying portion comprises, for example, rearwardly downwardly inclined parallel projections, horizontal parallel projections and forwardly downwardly inclined parallel projections, permitting the fluid to flow from the rear channel portion through the central part of the turn portion and to the front channel portion rapidly. In this case, many small projections are disposed in front of and in the rear of the rectifying portion to provide the fluid mixing portions, where the fluid is fully mixed.

With the layered heat exchanger thus constructed, the mixing portion and the rectifying portion provided in the turn portion of U-shaped channel of each flat tube rectify the flow of fluid and mix the fluid at the same time, enabling the fluid to flow through the channel turn portion smoothly to achieve an improved heat transfer coefficient. With the U-shaped channel of the conventional flat tube, the flow of fluid stagnates in the return channel portion upon passing through the turn portion, whereas the flat tube of the invention causes no stagnation, enabling the fluid to smoothly flow in the vicinity of channel turn portion of the tube free of stagnation or flow irregularities. The present flat tube is therefore diminished in fluid pressure loss and can be expected to exhibit greatly improved performance.

The small projections for forming the fluid mixing portion and the long projections for constituting the rectifying portion have a height equal to the depth of the recess, or a height which is twice the depth.

In the former case, the opposed small projections of the recess turn portions of the adjacent plates as fitted together with their recesses opposed to each other, as well as the opposed long projections, are joined together end-to-end.

In the latter case, the small projections and long projections in the recess turn portion are joined at their top ends to the bottom wall of turn portion of the plate opposed thereto. This gives an increased joint area and increases the pressure resistant strength of the heat exchanger.

The small projections for the mixing portion in the turn portion of U-shaped fluid channel of each flat tube at the central part thereof, or the long projections for forming the rectifying portion in the central part have a height equal to the depth of the recess. When the adjacent plates are joined to each other, those small or long projections are opposed to each other in corresponding relation, and are joined together end-to-end.

The layered heat exchanger of the invention is further characterized in that the U-shaped channel recess of each plate has front and roar straight channel forming portions provided with vertically elongated rectifying ridges having a height twice the depth of the recess, each pair of adjacent plates as fitted together having the rectifying ridges arranged alternately in different positions, the rectifying ridges each having an end joined to a bottom wall of the straight channel forming portion of the plate opposed thereto.

With this heat exchanger, the elongated rectifying ridges provided on the front and rear channel forming portions of channel recess of each plate permit the fluid to flow straight through the front and rear portions of U-shaped channel of the flat tube, consequently eliminating the likelihood of the fluid pressure loss increasing.

Further these elongated rectifying ridges have their top ends joined to the bottom wall of straight channel forming portion of the plate opposed thereto. This results in an increased joint area and imparts enhanced pressure resistant strength to the heat exchanger.

The vertically elongated rectifying ridges are arranged alternately in different positions in the assembly of adjacent plates as joined together. The turn portions of the opposed channel recesses have a multiplicity of small projections for forming the fluid mixing portion and long projections for forming the rectifying portion, and these projections are also alternately arranged in different positions in the assembly of adjacent plates. Accordingly, the elongated rectifying ridges, long projections and small projections on each plate can be smaller in number. The plates can therefore be formed easily.

The heat exchanger of the present invention is further characterized in that at least one of the adjacent plates in each pair is provided with a U-shaped divided channel forming ridge on the bottom wall of the channel forming recess, the pair of plates being fitted and joined to each other with the corresponding recesses opposed to each other to thereby form a plurality of U-shaped divided independent channels of reduced width inside the flat tube.

With the heat exchanger described, the fluid flows through the flat tube without mixing between the adjacent divided channels and free of stagnation. Accordingly, vapor-liquid separation is confined to only one divided channel, therefore diminishes and will not entail an increased fluid pressure loss.

The present invention further provides another layered heat exchanger comprising pairs of generally rectangular adjacent plates, each of the plates being formed in one side thereof with a U-shaped channel recess and a pair of header recesses continuous respectively with one end and the other end of the channel recess and each having a fluid passing opening, the plates being joined together in layers with the corresponding recesses of the plates in each pair opposed to each other to thereby form juxtaposed flat tubes each having a U-shaped fluid channel and front and rear headers communicating respectively with opposite ends of each flat tube for causing a fluid to flow through all the flat tubes and the headers, the heat exchanger being adapted to be exposed to air flowing from the front thereof rearward, the heat exchanger being characterized in that one of the front and rear headers has a fluid inlet at one end thereof, and one of the front and rear headers has a fluid outlet at the other end thereof, at least one of the front and rear headers being provided at an intermediate portion thereof with at least one partition to form a zigzag fluid passage divided into a plurality of passageways including an outlet passageway wherein the fluid flows countercurrently against the flow of air.

The heat exchanger described can be in the following three modes.

First, the fluid inlet is provided at one end of the rear header, and the fluid outlet is provided at the other end of the front header, each of the front and rear headers being provided with at least one partition intermediately thereof, the partition being even in total number and arranged on the rear and front sides alternately when seen from above in the direction of from the fluid inlet toward the fluid outlet, to thereby form a zigzag fluid passage divided into an odd number of passageways including an inlet passageway, an outlet passageway and an intermediate passageway between the two passageways, the outlet passageway permitting the fluid to flow therethrough countercurrently against the flow of air.

Second, the fluid inlet is provided at one end of the front header, and the fluid outlet is provided at the other end of the front header, each of the front and rear headers being provided with at least one partition intermediately thereof, the partitions being odd in total number and arranged on the front and rear sides alternately when seen from above in the direction of from the fluid inlet toward the fluid outlet, the partitions on the front header being one greater in number than on the rear leader, to thereby form a zigzag fluid passage divided into an oven number of passageways including an inlet passageway, an outlet passageway and an intermediate passageway between the two passageways, the outlet passageway permitting the fluid to flow therethrough countercurrently against the flow of air.

Third, the front header has the fluid inlet at one end thereof, the fluid outlet at the other end thereof and the partition at an intermediate portion thereof to thereby form a zigzag fluid passage divided into an inlet passageway and an outlet passageway, the outlet passageway permitting the fluid to flow therethrough countercurrently against the flow of air.

The layered heat exchanger in any of the above modes is useful, for example, as a layered evaporator for use in motor vehicle air conditioners. Since the flow of refrigerant through the outlet passageway is countercurrent against the flow of air, the temperature difference between superheated refrigerant and air to be subjected to heat exchange therewith is greater than in evaporators of the concurrent type wherein the superheated refrigerant is positioned downstream with respect to the direction of flow of air. The portion wherein the refrigerant is in a superheated state therefore achieves a high heat exchange efficiency. Consequently, this portion of the refrigerant passage can be diminished to provide a larger portion for the refrigerant in the form of a vapor and to assure stabilized heat exchange performance.

The invention will be described in greater detail with reference to the accompanying drawings.

BRIEF DESCRIPTION OF THE DRAWINGS

FIG, 1 is a schematic perspective view of a layered heat exchanger of the invention.

DESCRIPTION OF THE PREFERRED EMBODIMENTS

Figure 1:
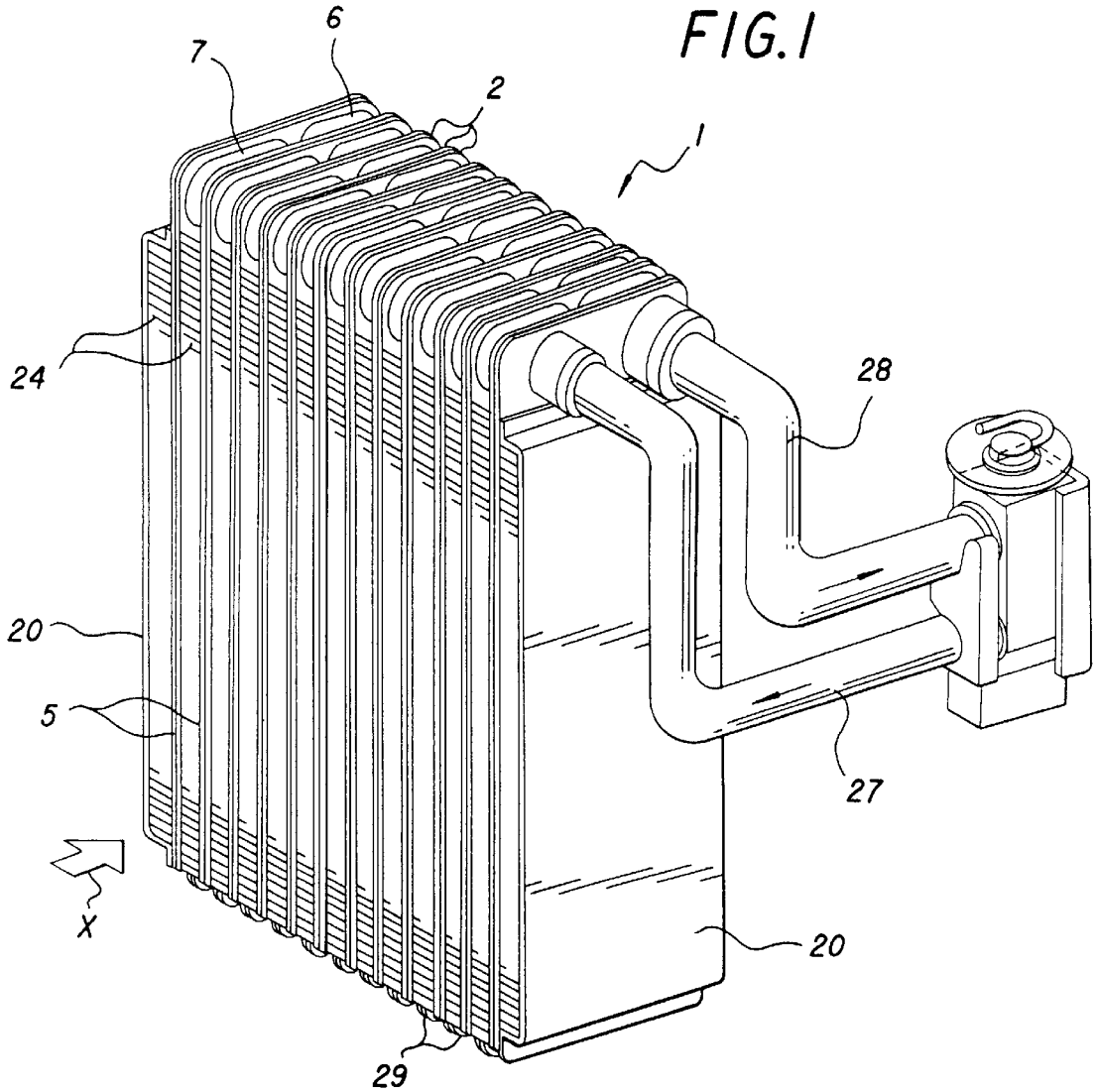

Throughout the drawings, like parts are designated by like reference numerals.

In this specification, the upstream side of flow of air (i.e., the left-hand side of FIG. 2) will be referred to as "front," the downstream side thereof (i.e., the right-hand side of FIG. 2) as "rear," and the terms "right" and "left" are used for the device as it is seen from the front rearward.

FIGS. 1 to 6 show a first embodiment of the invention, i.e., a layered heat exchanger, for use as a layered evaporator 1 in motor vehicle air conditioners.

With reference to these drawings, the evaporator 1 comprises pairs of generally rectangular adjacent plates 2 made of aluminum (including an aluminum alloy). Each of the plates 2 is formed in one side thereof with a U-shaped channel recess 3 and two header recesses 4, 4 continuous respectively with the upper-end front and rear portions of the recess 3. The recess 3 is provided with a vertically elongated partition ridge 9 extending centrally of the recess 3 from its upper end to a portion close to the lower end thereof. The ridge 9 has a height nearly equal to the depth of the recess 3. The plates 2 are fitted together in layers with the corresponding recesses 3, 3 and 4, 4 of the plates 2, 2 in each pair opposed to each other, and the opposed partition ridges 9, 9, as well as opposed peripheral edge portions 19, 19, of each pair of plates 2, 2 are joined to each other to thereby form U-shaped flat tubes 5, and a pair of front and rear headers 7, 6 commmunicating respectively with opposite ends of each flat tube 5. The opposed plates 2, 2 of each two adjacent flat tubes 5, 5 are joined at bottom walls 4*a*, 4*a* of their header recesses 4, 4 butted against each other and at spacing protrusions 29, 29 formed at the lower ends of the two plates 2, 2 and butting against each other. A corrugated fin 24 is interposed between the flat tubes 5, 5.

Side plates 20, 20 are arranged respectively on the right and left outer sides of the evaporator 1 with a corrugated fin 24 also provided between each side plate 20 and the flat tube 5. The side plates 20, 20 and the plates 2 therebetween are each prepared from an aluminum brazing sheet.

Figure 2:
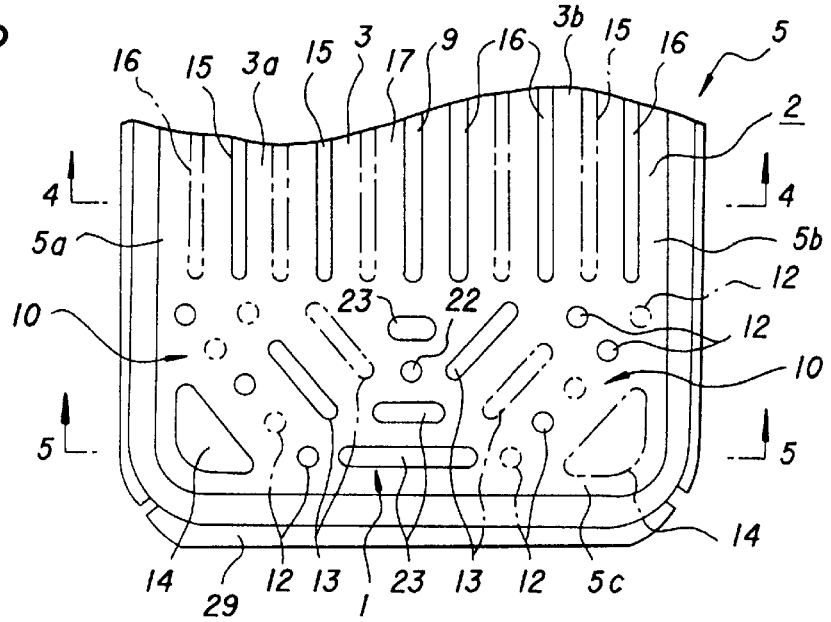
FIG. 2 is an enlarged fragmentary front view showing a plate of flat tube of the heat exchanger.
Figure 3:
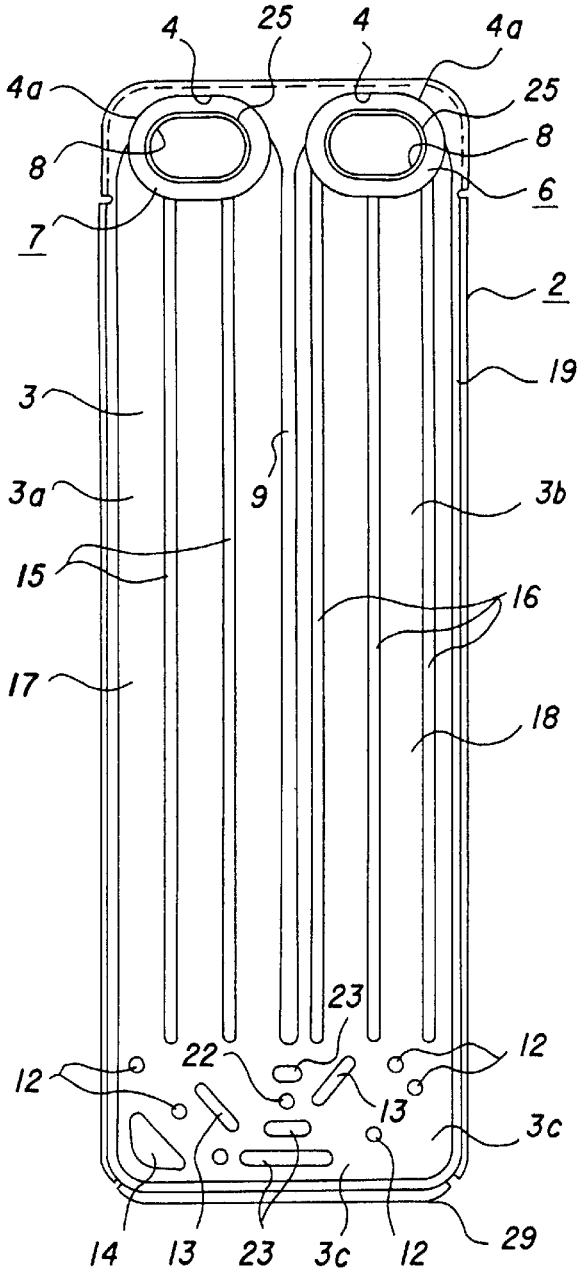
FIG. 3 is a front view of the plate.
Figure 4:
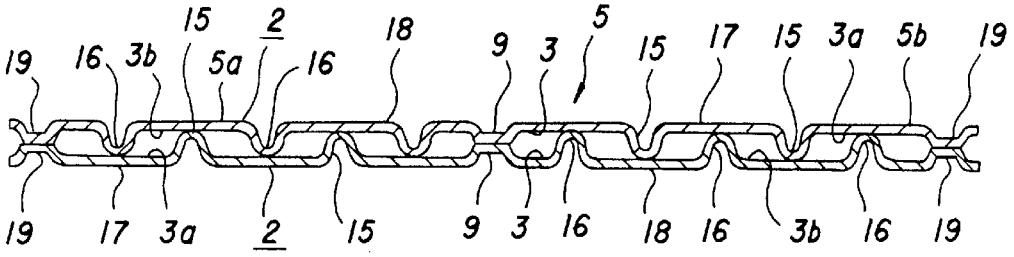
FIG. 4 is an enlarged view in section taken along the line 4—4 in FIG. 2.

With reference to FIGS. 2, 3 and 4, the U-shaped channel recess 3 of each plate 2 has front and rear straight channel forming portions 3*a*, 3*b* which are provided respectively with vertically elongated rectifying ridges 15, 16. These ridges have a height twice the depth of the recess 3. When the adjacent plates 2, 2 are fitted to each other, these ridges 15, 16 are arranged alternately in different positions. With the pair of plates 2, 2 fitted together, the ridges 15, 16 are positioned in front and rear straight channel portions 5*a*, 5*b* of a U-shaped refrigerant channel provided by the flat tube 5, and are arranged symmetically with respect to the central opposed partition ridges 9.

More specifically, the front straight channel forming portion 3*a* of recess 3 of each plate 2 of the present embodiment has two rectifying ridges 15 at widthwise intermediate positions, while the rear straight channel forming portion 3*b* has three rectifying ridges 16 close to opposite side edges and at widthwise midportion thereof.

The plates 2 are identical in shape. When the adjacent plates 2, 2 in each pair are fitted together with their recesses 3, 3 opposed to each other, the front straight channel forming portion 3*a* of one of the plates, i.e., first plate 2, is opposed to the rear straight channel forming portion 3*b* of the other plate, i.e., second plate 2, and the rear portion 3*b* of the first plate 2 is opposed to the front portion 3*a* of the second plate 2. Thus, the two rectifying ridges 15 of the front portion 3*a* of the first plate 2 and the three rectifying ridges 16 of the rear portion 3*b* of the second plate 2, which are five in total number, are arranged alternately, and at the same time, the three ridges 16 of the rear portion 3*b* of the first plate 2 and the two ridges 15 of the front portion 3*a* of the second plate 2, which are five in total, are arranged alternately. With the plates 2, 2 in each pair fitted together, these ridges 15, 16 are arranged symmetrically with respect to the central partition ridges 9 of the recesses 3.

Further with the two plates 2, 2 fitted together, the top end of each of the ridges 15, 16 is joined to the bottom wall 17 of the straight channel forming portion 3*a* (3*b*) of the plate 2 opposed thereto.

Figure 5:
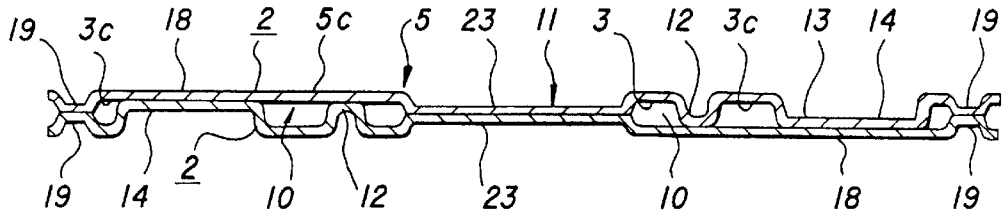
FIG. 5 is an enlarged view in section taken along the line 5—5 in FIG. 2.

Next with reference to FIGS. 2, 3 and 5, the U-shaped channel recess 3 of each plate 2 has a turn portion 3*c*, which is provided with a rectifying portion 11 in the center and refrigerant mixing portions 10, 10 on front and rear sides of the rectifying portion 11.

With the present embodiment, the turn portion 3*c* of U-shaped channel recess 3 of each plate 2 is provided with a multiplicity of small projections 12 for forming the refrigerant mixing portions 10 and long projections 13 for forming the rectifying portion 11. The projections other than those positioned in the center of the turn portion 3*c* have a height twice the depth of the recess 3. Each pair of adjacent plates 2, 2 as fitted together have the projections with the above-mentioned height arranged alternately in positions different from each other and have the top ends of these small projections 12 and long projections 13 butted against and joined to the bottom wall of the turn portion 3*c* of the plate 2 opposed thereto. Thus, the U-shaped refrigerant channel of the flat tube 5 has a channel turn portion 5*c* which is provided with refrigerant mixing portions comprising the multiplicity of small projections 12, and a rectifying portion comprising the parallel long projections 13.

Stated more specifically, the present embodiment has a long projection 13 inclined rearwardly downward and disposed in front of the center of turn portion 3*c* of recess 3 of each plate 2, a long projection 13 inclined forwardly downward and disposed in the rear of the center at a higher level than the former, and three horizontal long projections 23 and a circular small projection 22.

The front half of the turn portion 3*c* has three small projections 12 disposed at a specified spacing in an oblique arrangement inclined forwardly upward for forming one of the refrigerant mixing portion 10, and the rear half of the turn portion 3*c* has two small projections 12 spaced apart by a predetermined distance in an oblique arrangement inclined rearwardly upward and a small projection 12 at one side of this arrangement for forming the other mixing portion 10.

Further a generally triangular reinforcing projection 14 is provided in the turn portion 3*c* at a front-half lower corner which will not greatly contribute to heat exchange.

The rearwardly downwardly inclined long projection 13 in front of the center of the turn portion 3*c*, the forwardly downwardly inclined long projection 13 in the rear of the center, the small projection 12 other than the central one 22, and the reinforcing projection 14 have a height twice the depth of the recess 3. The three horizontal long projection 23 and the circular small projection 22 in the central part of the turn portion 3*c* have a height equal to the depth of the recess 3 like the central partition ridge 9 of the recess 3 and the plate peripheral edge portion 19.

When the adjacent first and second plates 2, 2 are fitted together with the recesses 3, 3 opposed to each other, the rearwardlly downwardly inclined long projection 13 in front of the center of recess turn portion 3*c* of the first plate 2 and the forwardly downwardly inclined long projection 13 in the rear of the center of the recess turn portion 3*c* of the second plate 2 (the latter projection 13 is reversed to opposed the first plate and therefore inclined rearwardly downward) are positioned at different levels, and the top end of each of these long projections 13 is joined to the bottom wall 18 of the turn portion 3*c* of the plate 2 opposed thereto.

The three small projections 12 of the turn portion front half of the first plate recess 3, the upper and lower two small projections 12, 12 in the rearwardly upward oblique arrangement of the turn portion rear half of the second plate 2 and the small projection 12 on the same plate at one side of the arrangement are positioned alternately. The reinforcing projection 14 at the lower front corner of the turn portion 3*c* of the second plate 2 is positioned opposite to the reinforcing projection 14 of the first plate 2, and is located at the lower rear corner of the second plate turn portion 3*c*. In the channel turn portion 5*c* of the U-shaped refrigerant channel of the flat tube 5 provided by the adjacent plates 2 as fitted together, these projections 12 and 14 are symmetric with respect to the center of the channel portion.

Further in the assembly of two plates 2, 2, the small projections 12, inclined long projections 13, 13 and reinforcing projection 14 of the turn portion 3*c* of recess 3 of the first plate 2 are joined each at its top end to the bottom wall 18 of turn portion 3*c* of the second plate 2 opposed thereto, and the three horizontal long projections 23 and one circular small projection 22 in the center of each turn portion 3*c* are each joined to the corresponding projection of the other turn portion 3*c* as butted thereagainst. Consequently, the channel turn portion 5*c* of U-shaped refrigerant channel of the flat tube 5 is provided with a rectifying portion 11 at its central portion, and a refrigerant mixing portion 10 disposed at each of front and rear sides of the rectifying portion 11 and comprising a multiplicity of small projections 12, the rectifying portion 11 comprising three long projections 23, small projection 22 and inclined long projections 13, 13 in front of and in the rear of these projections.

Figure 6:
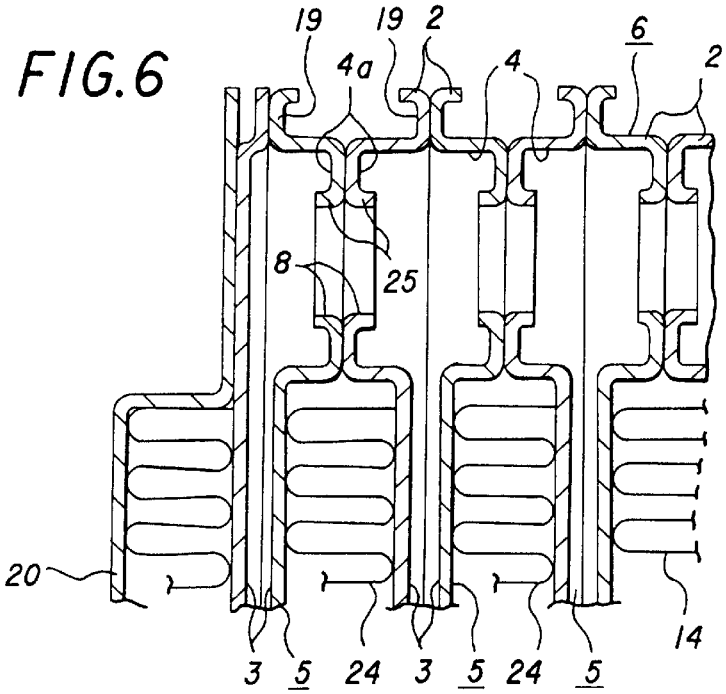
FIG. 6 is an enlarged fragmentary view in section of the heat exchanger, i.e., the first embodiment.

With reference to FIGS. 3 and 6, the front and rear header recesses 4, 4 each have a bottom wall 4*a* which is formed with a refrigerant passing opening 8 in the form of a circle which is elongated in the front-to-rear direction. The wall 4*a* has a circular wall 25 surrounding the opening 8 projecting inwardly of the recess 4.

With the evaporator 1 described above, a refrigerant introduced into the front header 7 from a refrigerant feed pipe 27 (see FIG. 1) at the right side of the evaporator flows into the flat tubes 5 from the header 7. The refrigerant flows through the U-shaped channel inside each tube 5 into the rear header 6.

The front and rear straight channel portions 5*a*, 5*b* of the flat tube 5 are provided respectively with the vertically elongated rectifying ridges 15, 16, so that the refrigerant flows straight through these channel portions 5*a*, 5*b* without entailing an increased refrigerant pressure loss when flowing through the U-shaped refrigerant channel of the flat tube 5.

The channel turn portion 5*c* of each flat tube 5 has the rectifying portion 11 in its central part and the refrigerant mixing portions 10, 10 on the front and rear sides of the rectifying portion 11. This rectifies the flow of refrigerant and mixes the refrigerant in the channel turn portion 5*c* at the same time, causing the fluid to flow smoothly through the turn portion 5*c* to achieve an improved heat transfer coefficient and eliminating stagnation and irregularities from the flow of refrigerant in the vicinity of the channel turn portion 5*c* for the evaporator to exhibit further improved performance.

The refrigerant is discharged from the rear header 6 to the outside via a refrigerant discharge pipe 28 connected to the right end of the header 6.

On the other hand, air flows through the clearances accommodating corrugated fins 24 and formed between the adjacent flat tubes 5 of the evaporator 1 and between the tube 5 and the side plate 20 at each end, whereby the refrigerant and air are efficiently subjected to heat exchange through the plates 2 and the corrugated fins 24.

It is desired to provide a partition at the bottom of header recess 4 of the plate 2 at a required part of each of the rear and front headers 6, 7 of the evaporator 1 as will be described later so that the refrigerant flows through the evaporator 1 zigzag in its entirety.

According to the present embodiment, the ridges 15, 16 of the front and rear straight channel forming portions of the channel recess 3 of each plate 2, and the long projections 13 and small projections of the channel turn portion 3*c* of the recess 3 have a height twice the depth of the recess 3 and are joined at their top ends to the respective bottom walls 17 and 18 of the plate opposed thereto. The ridges 15, 16, long projections 13 and small projections 12 are therefore each joined over an increased area, giving enhanced pressure resistant strength to the evaporator 1.

The vertically elongated rectifying ridges 15, 16 of the front and rear straight channel forming portions 3*a*, 3*b* of the channel recesses 3 are provided for the front and rear straight channel. portions 5*a*, 5*b* of refrigerant channel of the flat tube 5 of the adjacent plates 2, 2 as joined together and are positioned symmetrically on the front and rear sides of the channel center line. The turn portions 3*c* of the opposed recesses 3 have the multiplicity of small projections 12 for forming the refrigerant mixing portions 10 and the long projections 13 for forming the rectifying portion 11, and these projections, except for those positioned centrally of the turn portions 3*c*, are alternately arranged inside the assembly of adjacent plates 2, 2 and are positioned symmetrically as a whole on the front and rear sides of the turn portion center line. Because of these features, the long rectifying ridges 15, 16, long projections 13 and projections 12 on each plate 2 can be smaller in number. The plate 2 can therefore be formed by facilitated press work.

Figure 7:
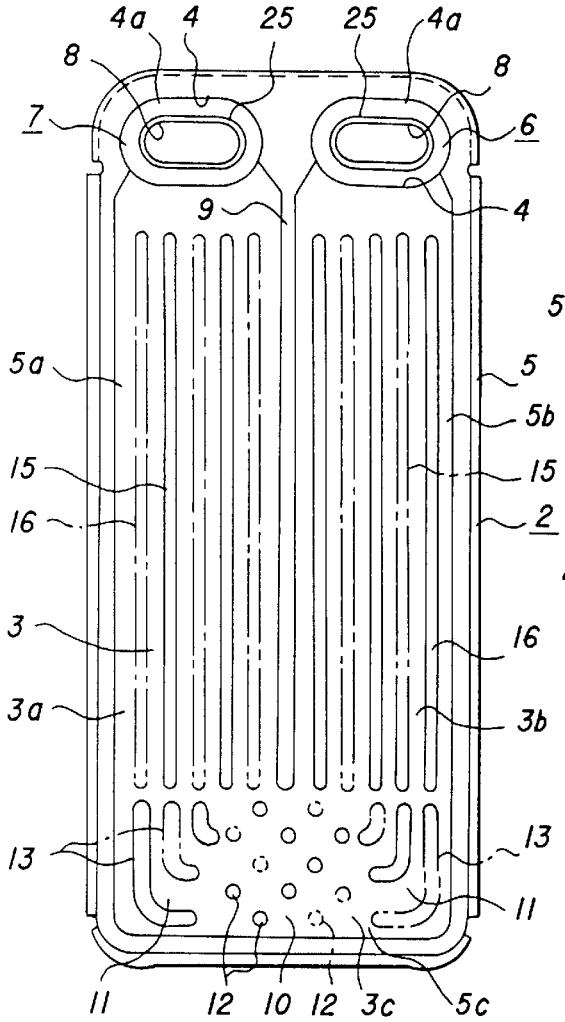
FIG. 7 is an enlarged fragmentary front view showing a plate of flat tube in a heat exchanger as a second embodiment of the invention.

FIG. 7 shows a second embodiment of the present invention, which differs from the first embodiment in that the U-shaped refrigerant channel turn portion 5*c* of each flat tube 5 is provided with a refrigerant mixing portion 10 in its central part and rectifying portions 11, 11 at the front and rear sides of the mixing portion 10.

More specifically, the turn portion 3*c* of U-shaped refrigerant channel recess 3 of each plate 2 has seven small projections 12 for forming the mixing portion 10. These projections 12, except for those positioned centrally of the turn portion 3*c*, have a height twice the depth of the recess 3. With the adjacent plates 2, 2 fitted together, such projections 12 with the above-mentioned height are arranged alternately and positioned symmetrically in the front and rear parts of the whole channel turn portion 5*c* of U-shaped refrigerant channel of the flat tube 5. Like the partition ridge 9 at the widthwise midportion of the recess 3 and the plate peripheral edge portion 19, the two circular small projections 22 in the center of the turn portion 3*c* have a height equal to the depth of the recess 3.

The front part of recess turn portion 3*c* is provided with two parallel long projections 13 generally L-shaped, having an inward horizontal portion and larger in size when positioned outward, and a long projection 13 generally L-shaped and positioned in the rear of the former projection. These projections 13 have a height twice the depth of the recess 3. With the adjacent plates 2, 2 fitted together, these projections of the plates are arranged alternately and positioned symmetrically as a whole in the front and rear parts of the turn portion 5*c* of U-shaped refrigerant channel of the flat tube 5.

The adjacent plates 22 are fitted to each other in layers with their recesses 3, 3 opposed, and in the recess turn portion 3*c* of one of the plates, i.e., first plate 2, the small projections 12 and the L-shaped long projections 13 are joined at their top ends to the bottom wall 18 of turn portion 3*c* of the other plate, i.e., second plate 2. Thus, the U-shaped refrigerant channel turn portion 5*c* of the flat tube 5 is formed with the refrigerant mixing portion 10 centrally thereof which portion 10 comprises a multiplicity of small projections 22, 12, and rectifying portions 11, 12 positioned at the front and rear sides of the portion 10 and comprising generally L-shaped long projections 13.

With the evaporator 1 of the second embodiment as in the case of the first embodiment, the refrigerant flows straight through the front and rear straight channel portions 5*a*, 5*b* of the flat tube 5 when flowing through the U-shaped channel inside each flat tube 5. In the channel turn portion 5*c*, the refrigerant rapidly flows along the L-shaped parallel long projections 13 when passing through the front and rear rectifying portions 11, 11. The multiplicity or small projections 12 of the mixing portion 10 thoroughly mixes the refrigerant in the central part of the channel turn portion 5*c*.

Consequently the channel turn portion 5*c* of each flat tube 5 rectifies the flow of refrigerant and mixes the fluid at the same time, permitting the refrigerant to flow through this portion 5*c* smoothly to achieve an improved heat transfer coefficient. With the U-shaped channel of the conventional flat tube, the flow of refrigerant stagnates in the return channel portion upon passing through the turn portion, whereas the flat tube of the invention is free of stagnation, is diminished in refrigerant pressure loss and can therefore be expected to exhibit greatly improved performance.

Figure 9:
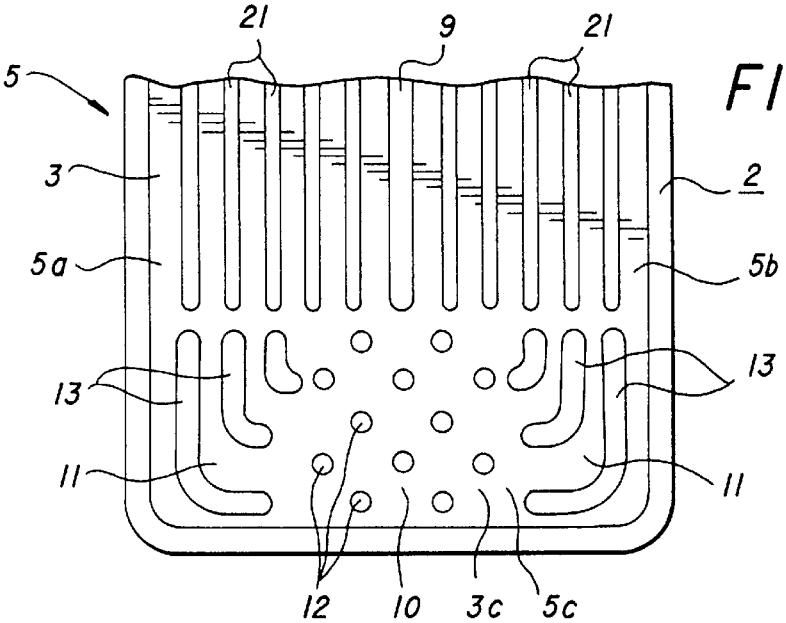
FIG. 9 is an enlarged fragmentary front view showing plates of flat tubes of the heat exchanger.
Figure 8:
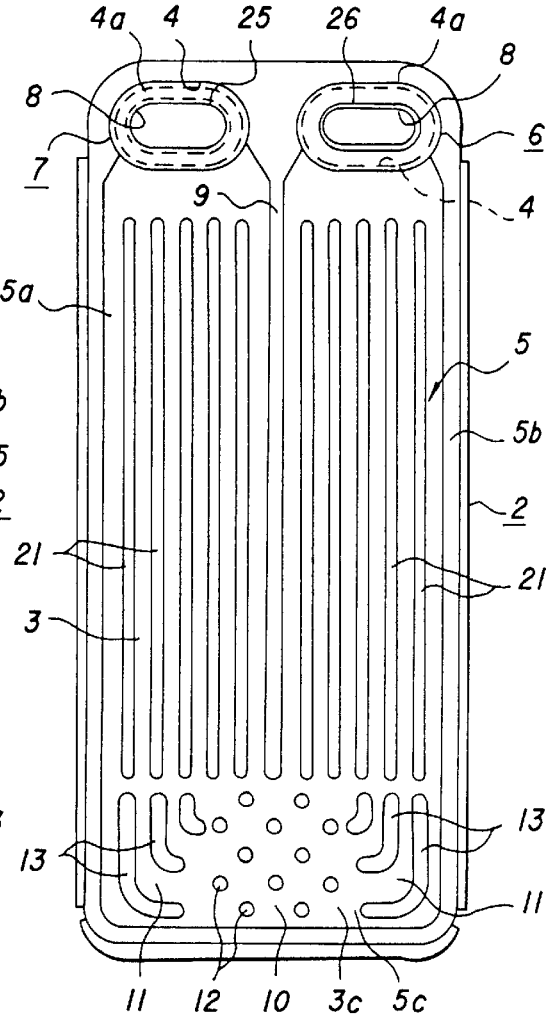
FIG. 8 is an enlarged fragmentary front view showing a plate of flat tube of a heat exchanger as a third embodiment of the invention.

FIGS. 8 to 11 show a third embodiment of the invention, which differs from the second embodiment with respect to the following. With reference to FIGS. 8 and 9, the front and rear straight channel forming portions at opposite sides of the central partition ridge 9 of the channel recess 3 of each plate 2 are provided with vertically elongated rectifying ridges 21 which are arranged in parallel at a spacing and which have a height equal to the depth of the recess 3 (accordingly equal to the height of the ridge 9). The turn portion 3*c* has front and rear rectifying portions 11, 11, which comprise generally L-shaped long projections 13 equidistantly arranged in parallel, having an inward horizontal portion and increasing in size forwardly or rearwardly outward. The turn portion 3*c* has in its central part small projections which are twelve in total number to provide a refrigerant mixing portion 10. These long projections 13 and small projections 12 have a height equal to the depth of the recess 3 (accordingly equal to the height of the partition ridge 9).

With the layered evaporator 1 described which comprises pairs of adjacent plates 2, 2, each pair of adjacent plates 2, 2 are joined together with their recesses 3, 3, as well as the recesses 4, 4, opposed to each other. At this time, the central partition ridges 9 of the channel recesses 3, 3, as well as the vertically elongated rectifying ridges 21 of the straight channel forming portions at the front and rear sides of the ridges 9, are joined together end-to-end. In the turn portions 3*c*, 3*c* of the recesses 3, 3, the opposed small projections 12, as well as the opposed long projections 13, are joined together end-to-end. Consequently, the adjacent plates 2, 2, when fitted together, provide a flat tube 5 having a U-shaped refrigerant channel of exactly the same shape as those of the first embodiments. The flat tubes 5 thus formed are arranged side by side.

As is the case with the second embodiment, therefore, the channel turn portion 5*c* of each flat tube 5 rectifies the flow of refrigerant and mixes the refrigerant at the same time, achieving an improved heat transfer coefficient and diminishing the refrigerant pressure loss to result in improved performance.

Figure 10:
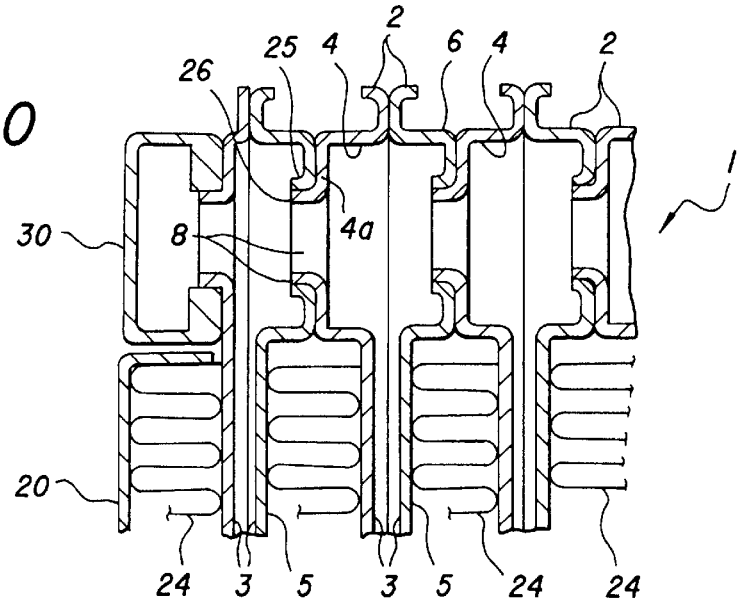
FIG. 10 is an enlarged fragmentary view in section of the heat exchanger.

With reference to FIG. 10, the bottom walls 4*a*, 4*a* of the front and rear two header recesses 4, 4 of each plate 2 are each formed with a refrigerant passing opening 8 in the form of a circle which is elongated in the front-to-rear direction. Each opening 8 in one of the two adjacent plates 2, 2 is defined by a first annular wall 25 projecting inwardly of the header recess 4. Each opening 8 in the other plate 2 is defined by a second annular wall 26 projecting outward from the header recess 4 and fittable in the first annular wall 25. When a multiplicity of plates 2 are fitted together in layers to form parallel flat tubes 5, the adjacent flat tubes 5, 5 have plates 2, 2 which are opposed to each other. These plates 2, 2 are brazed to each other with the second annular wall 26 of each header recess bottom wall 4*a* of one of the plates 2, 2 fitting in the first annular wall 25 of each header recess bottom wall 4*a* of the other plate 2.

Figure 11:
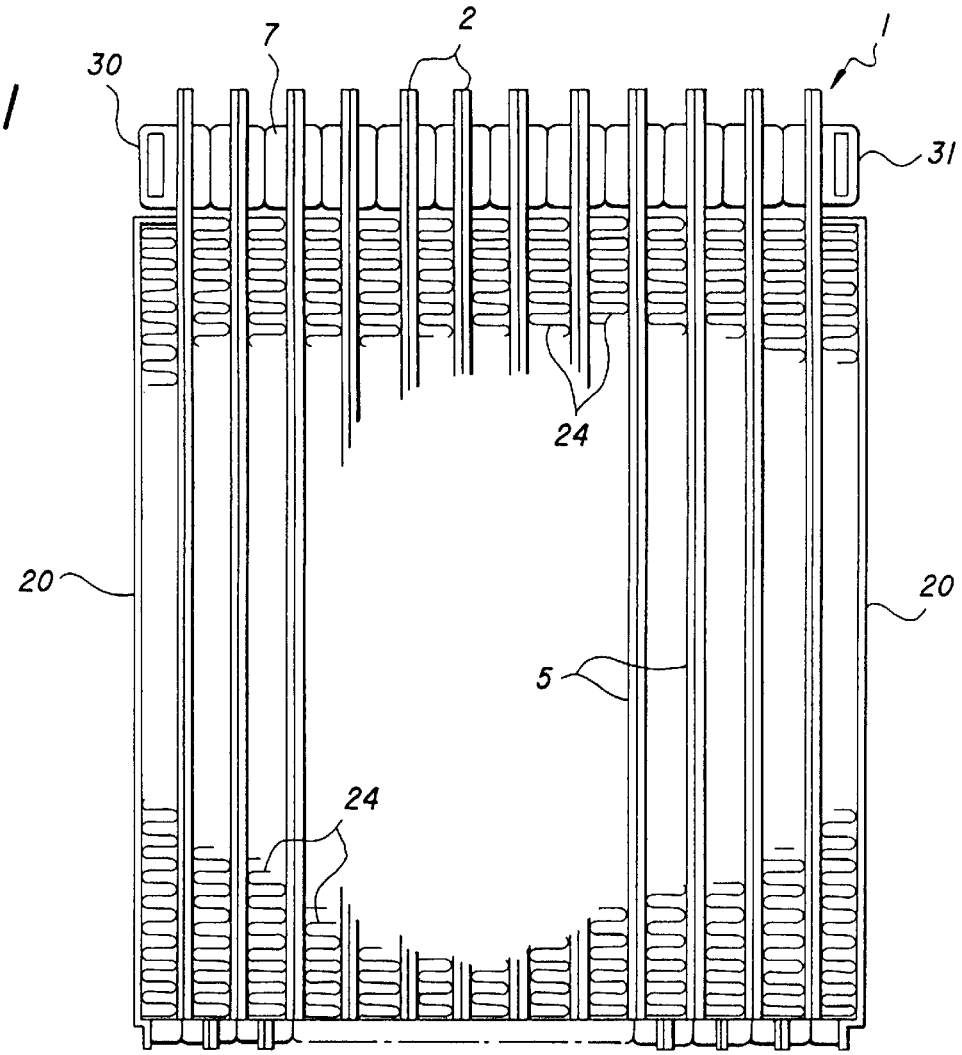
FIG. 11 is a schematic front view of the heat exchanger.

Further as shown in FIG. 11, a refrigerant inlet pipe 30 is connected to the left ends of the front and rear headers 7, 6 of the evaporator 1, and a refrigerant outlet pipe 31 to the right ends of the headers 7, 6.

Figure 12:
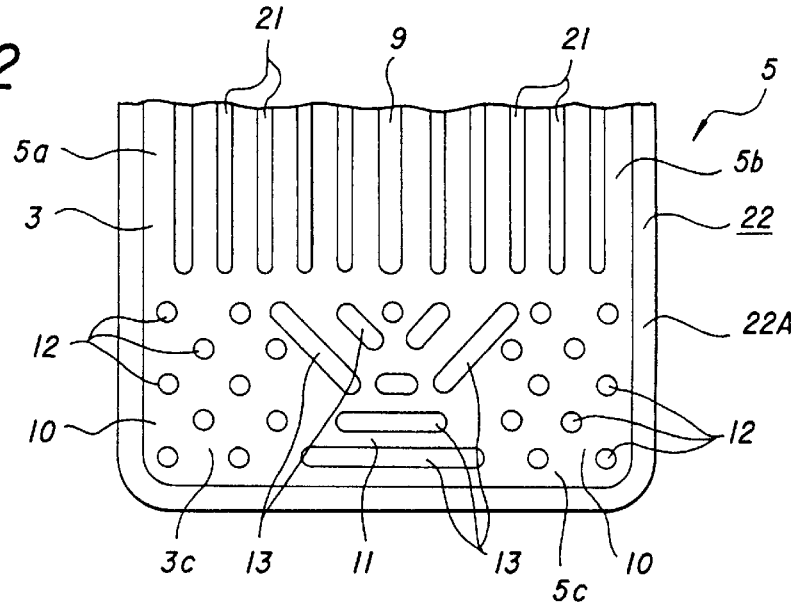
FIG. 12 is an enlarged fragmentary front view showing a plate of flat tube of a heat exchanger as a fourth embodiment of the invention.
Figure 13:
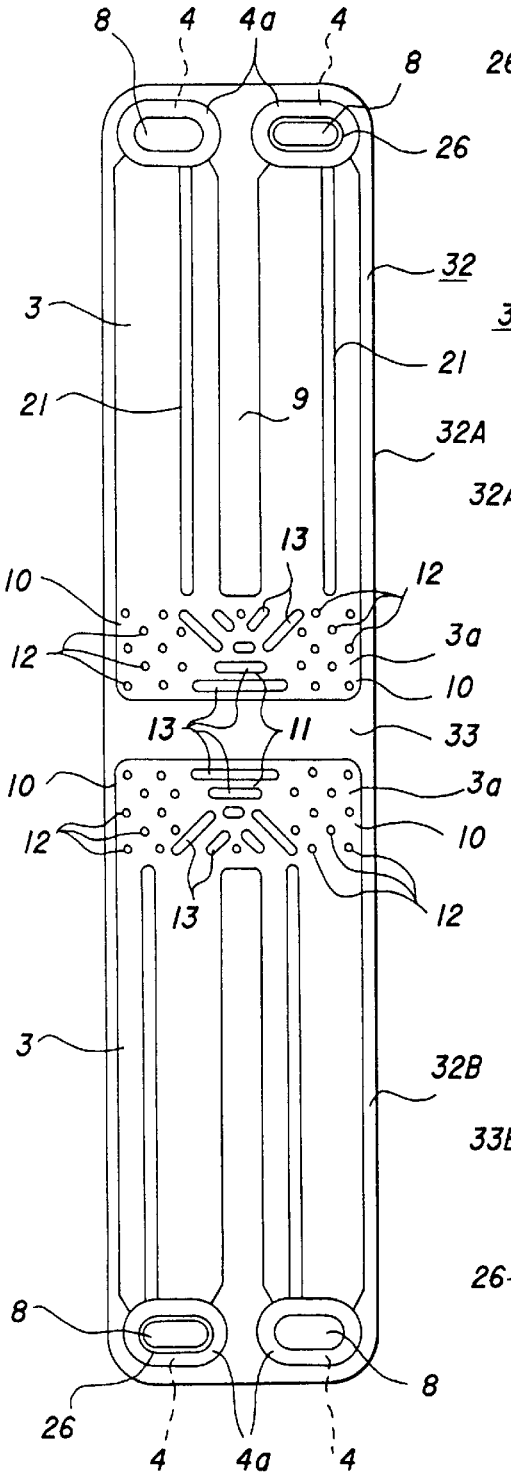
FIG. 13 is a front view showing a plate for use in a fifth embodiment of the invention before folding.
Figure 14:
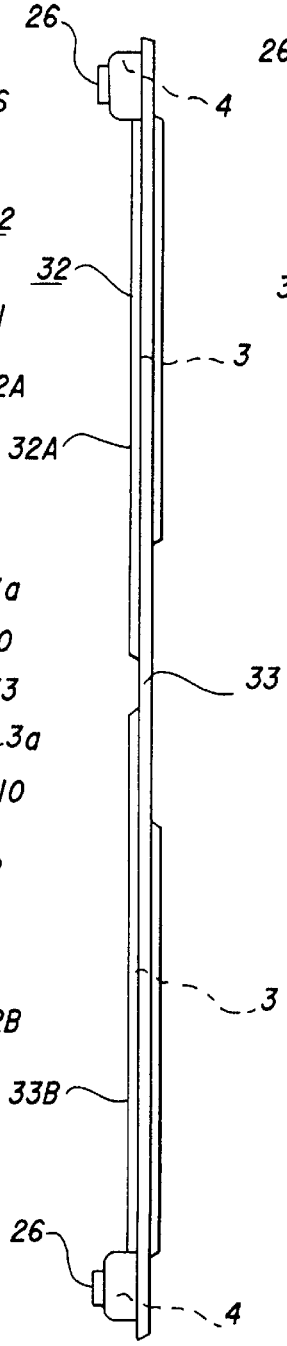
FIG. 14 is a side elevation of the plate.
Figure 15:
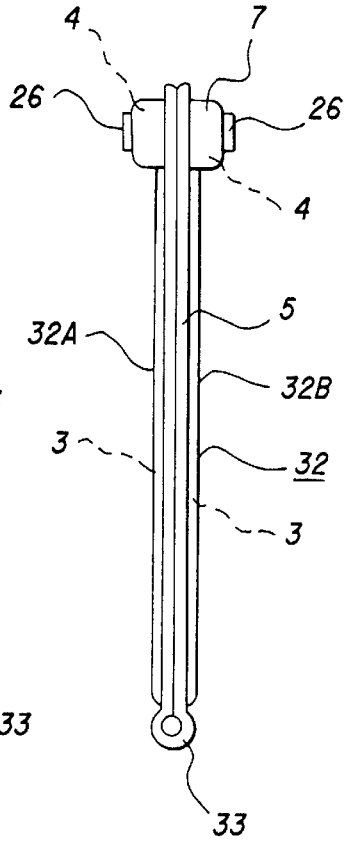
FIG. 15 is an enlarged fragmentary front view showing a plate of flat tube of a heat exchanger as the fifth embodiment.
Figure 16:
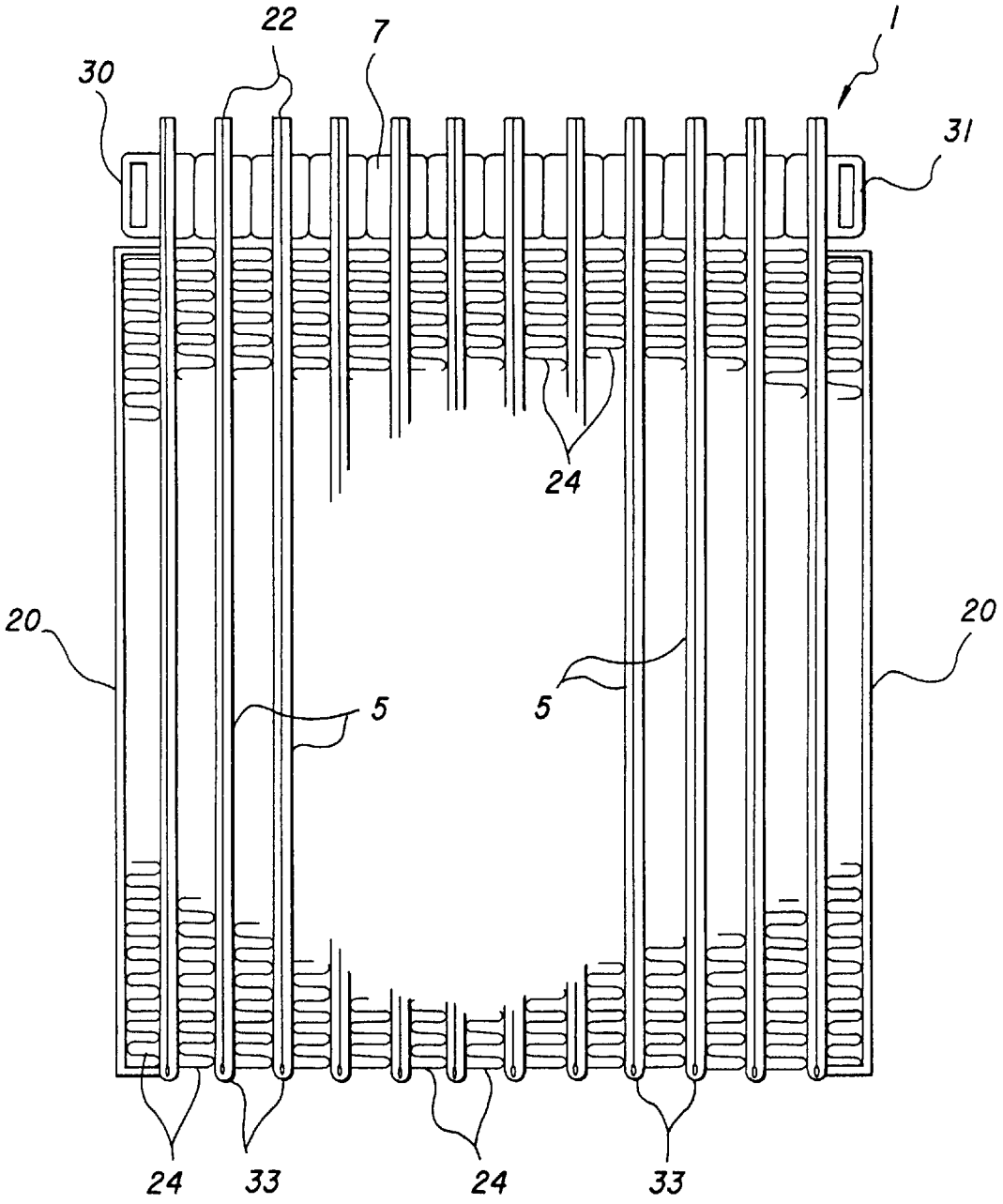
FIG. 16 is a schematic front view of the heat exchanger.

FIG. 12 shows a fourth embodiment of the invention, in which as in the third embodiment, the front and rear straight channel forming portions at opposite sides of the central partition ridge 9 of channel recess 3 of each plate 2 are provided with vertically elongated rectifying ridges 21 which are equidistantly arranged in parallel and which have a height equal to the depth of the recess 3 (accordingly equal to the height of the ridge 9).

Further as is the case with the first embodiment, the turn portion 3*c* of U-shaped channel recess 3 of each plate 2 has a rectifying portion 11 centrally thereof, and refrigerant mixing portions 10, 10 in front of and in the rear of the portion 11.

Although a multiplicity of small projections 12 for forming the mixing portions 10 and long projections 13 for forming the rectifying portion 11 are arranged in substantially the same pattern as in the first embodiment, the small projections 12 of the mixing portion 10 and the long projections 13 of the rectifying portion 11 have a height equal to the depth of the recess 3 (accordingly equal to the height of the partition ridge 9).

The channel turn portion 3*c* has no reinforcing projection at a corner thereof.

With the layered evaporator 1 described above which comprises pairs of adjacent plates 2, 2, each pair or adjacent plates 2, 2 are joined together with their recesses 3, 3, as well as the recesses 4, 4, opposed to each other. At this time, the central partition ridges 9 of the channel recesses 3, 3, as well as the vertically elongated rectifying ridges 21 of the straight channel forming portions 3*a*, 3*b*, are joined together end-to-end. In the turn portions 3*c*, 3*c* of the recesses 3, 3, the opposed small projections 12 of the nixing portions 10, as well as the opposed long projections 13, are joined together end-to-end. Consequently, a U-shaped refrigerant channel of substantially the same shape as in the first embodiment is formed in each flat tube 5 of the evaporator 1.

Thus, the channel turn portion 5*c* rectifies the flow of refrigerant and mixes the refrigerant at the same time when the refrigerant flows three each flat tube 5. The same effect and advantage as in the case of the first embodiment can therefore be expected.

FIGS. 13 to 16 show a fifth embodiment of the invention, which differs from the fourth embodiment in respect of the following. This embodiment, i.e., layered evaporator 1, comprises plates 32 having a size corresponding to two plates 2 of the fourth embodiment as interconnected by a joint 33. Flat tubes 5 and front and rear headers 7, 6 communicating with the front and rear ends of U-shaped refrigerant channels of the tubes 5 are formed by folding the plates 32.

Each of the upper half 32A and lower halft 32B has a U-shaped channel forming recess 3 including a turn portion 3*c*, the central part of which has a rectifying portion 11. Refrigerant mixing portions 10, 10 are provided in front of and in the rear of the rectifying portion 11. However, this embodiment has exactly the same construction as the fourth embodiment with respect to the following. The recess 3 has front and rear straight channel forming portions on the front and rear sides of its central partition ridge 9, and these portions have vertically elongated rectifying ridges 21 which are spaced apart by a distance in parallel and which have a height equal to the depth of the recess 3. A multiplicity of small projections 12 for forming the refrigerant mixing portions 10 and long projections 13 for forming the central rectifying portion 11 are arranged in the same pattern as in the fourth embodiment.

The small projections 12 for forming the mixing portion 10 and the long projections 13 for constituting the rectifying portion 11 in the first to fifth embodiments are not limited in shape to those illustrated but can be shaped otherwise.

FIGS. 17 to 21 and FIG. 24 show a sixth embodiment of the invention, i.e., a layered evaporator 1.

Each plate 2 of the evaporator 1 has a channel recess 3, which has a vertically elongated partition ridge 9 at the widthwise midportion thereof. The ridge 9 has the same height as the peripheral edge portion 19 of the plate 2 and extends from the upper end of the recess 3 to a position close to the lower end thereof.

The recess 3 of the plate 2 has a multiplicity of ridges 15, 16 having a height twice the depth of the recess 3. While the evaporator 1 comprises pairs of adjacent plates 2, the ridges 15, 16 of each pair of plates 2, 2 as joined together form independent parallel U-shaped divided refrigerant passages inside a flat tube 5 provided by the pair.

Figure 20:
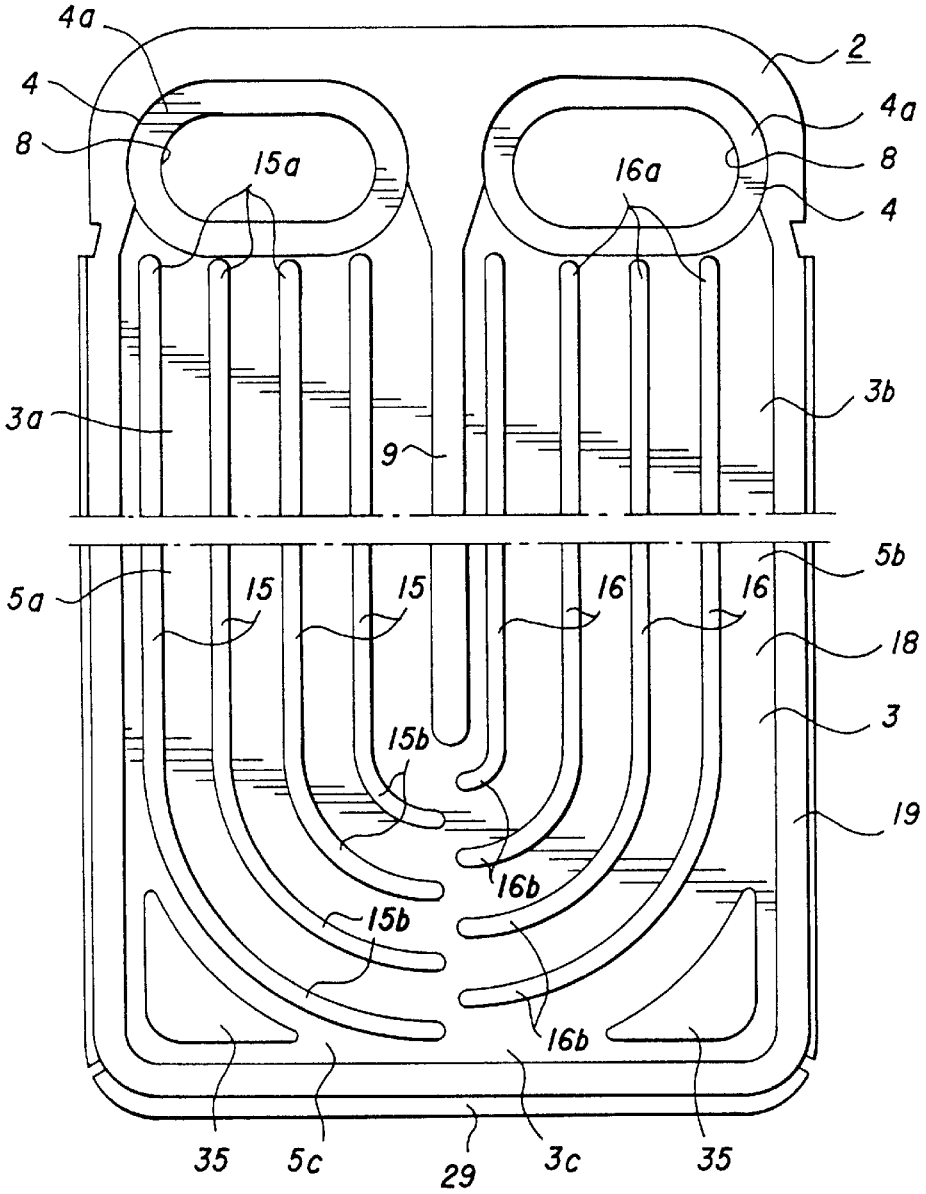
FIG. 20 is an enlarged fragmentary front view showing the plate of flat tube of the heat exchanger.

Stated more specifically with reference to FIG. 20, each ridge 15 (16) comprises a straight portion 15*a* (16*a*) provided in a front (rear) straight channel forming portion 3*a* (3*b*) of the recess 3, and a quarter circular-arc portion 15*b* (16*b*) provided in a turn portion 3*c* of the recess and continuous with the straight portion. The ridge has exactly one half of U-shape.

When the pair of plates 2 are fitted together with their recessed 3, 3 opposed to each other, these straight portions 15*a*, 16*a* and the quarter circular-arc portions 15*b*, 16*b* of the ridges 15, 16 are arranged alternately.

With the two plates 2, 2 fitted together, the opposed partition ridges 9, 9, as well as the opposed plate peripheral edge portions 19, 19, butt against and are joined to each other, and the straight portions 15*a*, 16*a* and circular-arc portions 15*b*, 16*b* of the ridges 15, 16 are joined at their top ends to the bottom wall 18 of recess of the plate 2 opposted thereto, whereby nine parallel U-shaped refrigerant passages as divided by the ridges 15, 16 are formed in the U-shaped refrigerant channel of the flat tube 5. The turn portion of each passage is semicircular.

Figure 21:
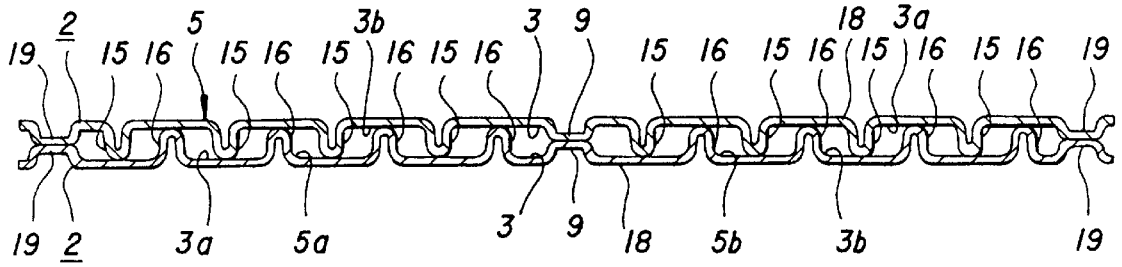
FIG. 21 is a view in horizontal section of the flat tube of the heat exchanger.

As shown in FIG. 21, the divided passages are nearly square in cross section so as to permit uniform distribution of liquid throughout the U-shaped refrigerant channel of the flat tube 5 and to ensure a joint area between the tube 5 and a fin 24. With respect to the cross sectional area of the divided passages, those positioned inward are largest, outward passages are smallest, and intermediate passages are equal to one another or larger if closer toward inside. This renders the flow velocity uniform transversely of the channel.

Figure 19:
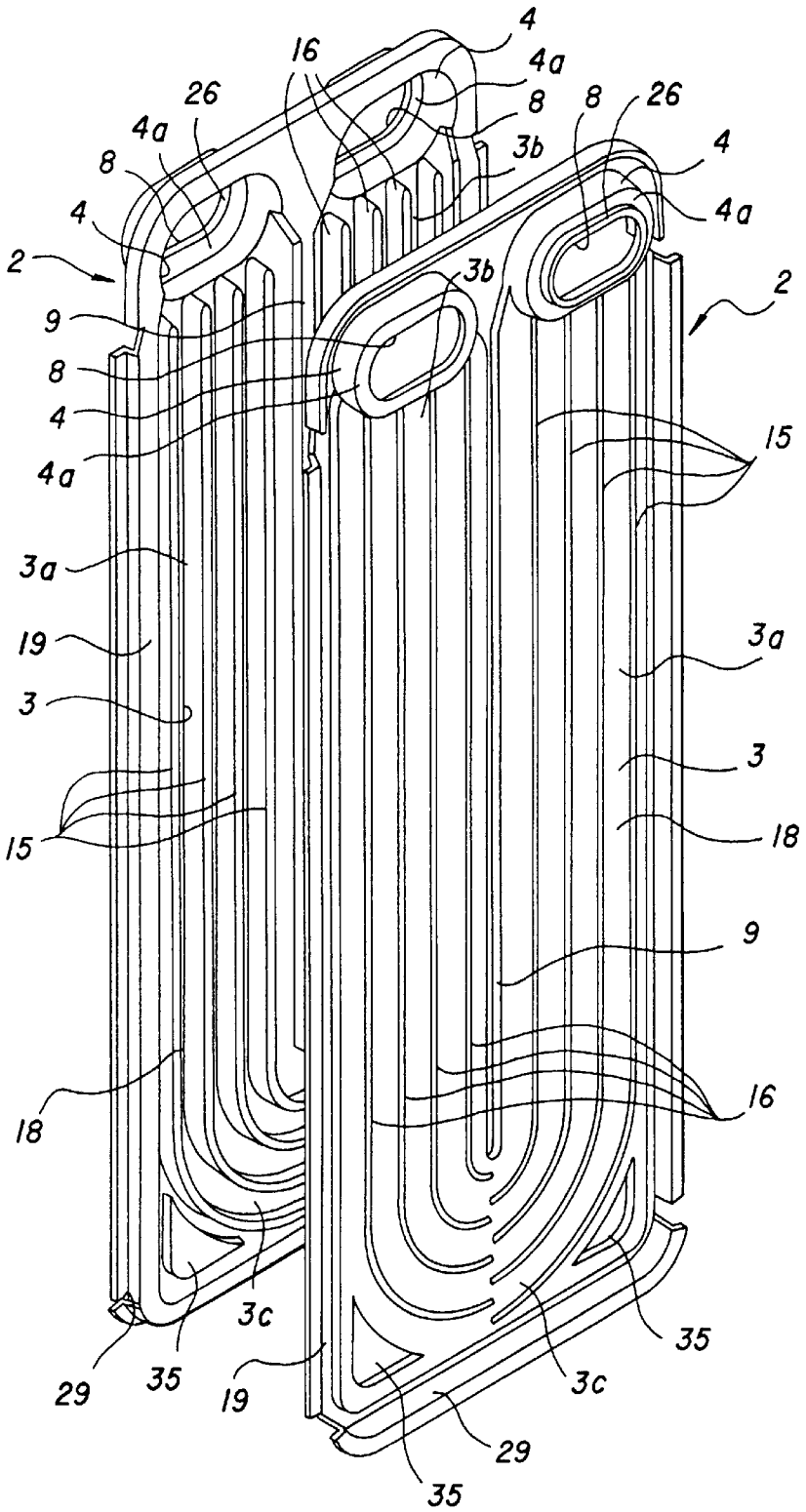
FIG. 19 is a perspective view of plates constituting the heat exchanger.

Generally triangular front and rear reinforcing projections 35 having the same height as the peripheral edge portion 19 of the plate 2 are provided respectively at the lower-end front and rear corners of the plate 2 (see FIGS. 19 and 20).

Further as seen in FIG, 38, each plate 2 has two header recesses 4, 4 each having a refrigerant passing opening 8. The opening 8 of one of the recesses 4 has art annular wall 26 formed by burring and projecting outward from the recess 4. When the opposed plates 2, 2 of each two adjacent flat tubes 5 are fitted together in the front and rear headers 7, 6, the annular wall 26 around the opening 8 of the header recess 4 of one of the plates 2 is fitted in the opening 8 of the recess 4 of the other plate 2 opposed thereto.

Figure 24:
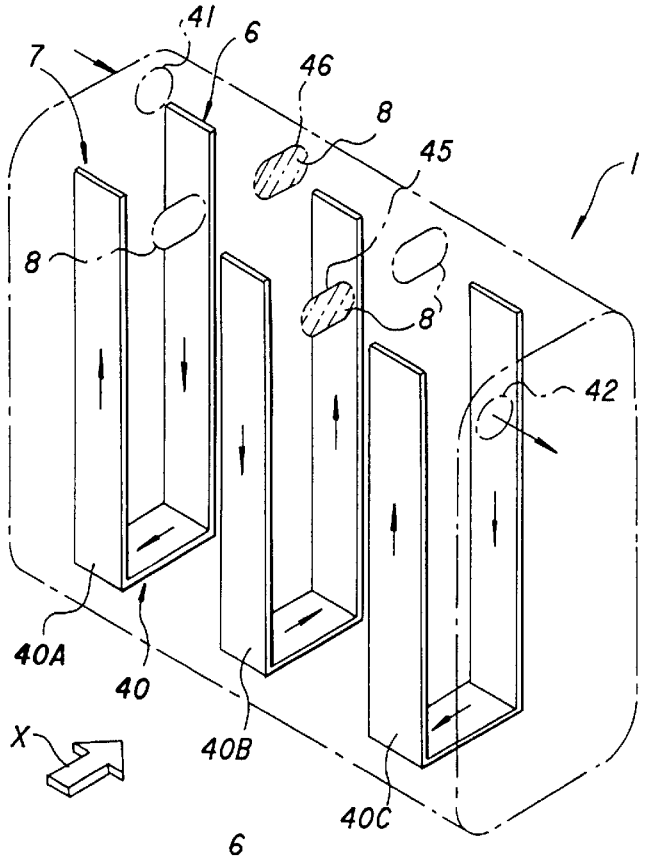
FIG. 24 is a schematic perspective view of the refrigerant passage of heat exchanger of FIG. 17.

FIG. 24 shows the overall refrigerant passage of layered evaporator 1 off the sixth embodiment which will be described below.

With reference to the drawing, a refrigerant inlet 41 is provided at the left end of rear header 6 of the evaporator 1, and a refrigerant outlet 42 at the right end of the front header 7.

The rear header 6 has a partition 46 at a position rightwardly away from its left end by about ⅓ of the length of the header. The front header 7 has a partition 45 at a position leftwardly away from its right end by about ⅓ of the length of the header. The rear header partition 46 is formed by not forming the refrigerant passing opening in the recess of the plate 2 concerned. The front header partition 45 is formed similarly by not forming the opening.

A refrigerant inlet pipe 30 has an opening corresponding to the refrigerant inlet 41, and a refrigerant outlet pipe 31 has an opening corresponding to the refrigerant outlet 42. A zigzag refrigerant passage 40 is thus formed which is divided into three passageways, i.e., an inlet passageway 40A, outlet passageway 40C and intermediate passageway 40B between the two passageways 40A, 40C, and in which the refrigerant flows through the outlet passageway in a countercurrent relation with the flow of air.

The refrigerant is introduced into the rear header 6 through a feed pipe 27 and the inlet pipe 30 at the left side of the evaporator 1 (see FIG. 17) by way of the refrigerant inlet 41. The refrigerant is turned by the rear header partition 46 and flows through the inlet passageway 40A countercurrently against the air flow, is turned by the front header partition 45 and flows through the intermediate passageway 40B concurrently with the air flow, then flows through the outlet passageway 400 countercurrently against the air flow and is thereafter discharged from a discharge pipe 28 via the outlet 42.

On the other hand, air flows in the direction of arrow X shown in the drawing, that is, from the front rearward to pass through the clearances between the adjacent flat tubes 5 and between each side plate 20 and the tube 5 adjacent thereto, the clearances having corrugated fins 24 accommodated therein, whereby the refrigerant and the air are efficiently subjected to heat exchange through the plates 2 and the fins 24.

With the sixth embodiment described, the refrigerant flows into the evaporator 1 as separated into a vapor and liquid, for example, in a volume ratio of 3:7. Inside the roar header 6, therefore, the liquid stays at a lower position due to a specific gravity difference, and the refrigerant flows into the flat tube 5 at an approximately uniform vapor-liquid distribution ratio with respect to the widthwise direction. Since the height of inner edge of the recess 3 is greater than that of the outer edge thereof, the vapor is caused to flow into the innermost divided refrigerant passage preferentially. The refrigerant boils within the flat tube 5 to result in an increasing vapor phase ratio.

The refrigerant flows through the U-shaped refrigerant channel of each flat tube 5 without mixing between the adjacent divided passages and free of stagnation. Accordingly, vapor-liquid separation occurs in only one divided passage, therefore diminishes and will not entail an increased refrigerant pressure loss. The refrigerant smoothly flows especially through the turn portion, whereby an improved heat transfer coefficient can be attained. Further in the vicinity of the turn portion of the U-shaped flat tube 5, the refrigerant flows free of stagnation or irregular flows, while traces of oil contained in the refrigerant will not stay. Moreover, the difference in average temperature between the refrigerant and the atmosphere becomes diminished, leading to a further improved heat transfer coefficient, The partitions 45, 46 in the respective front and rear headers 7, 6 need not always be disposed at a position away from the right or left end by exactly ⅓ of the length of the headers, but the position can be suitably altered rightward or leftward with the heat exchange efficiency taken into consideration. Although the sixth embodiment described has three passageways 40A to 40C, two partitions 45 and two partitions 46 may be provided in the front and rear headers 7, 6, respectively, as arranged alternately to provide five passageways including an outlet passageway wherein a countercurrent flow is produced against the air flow. An odd number of passageways, not smaller than 7 in number, can be used.

Figure 22:
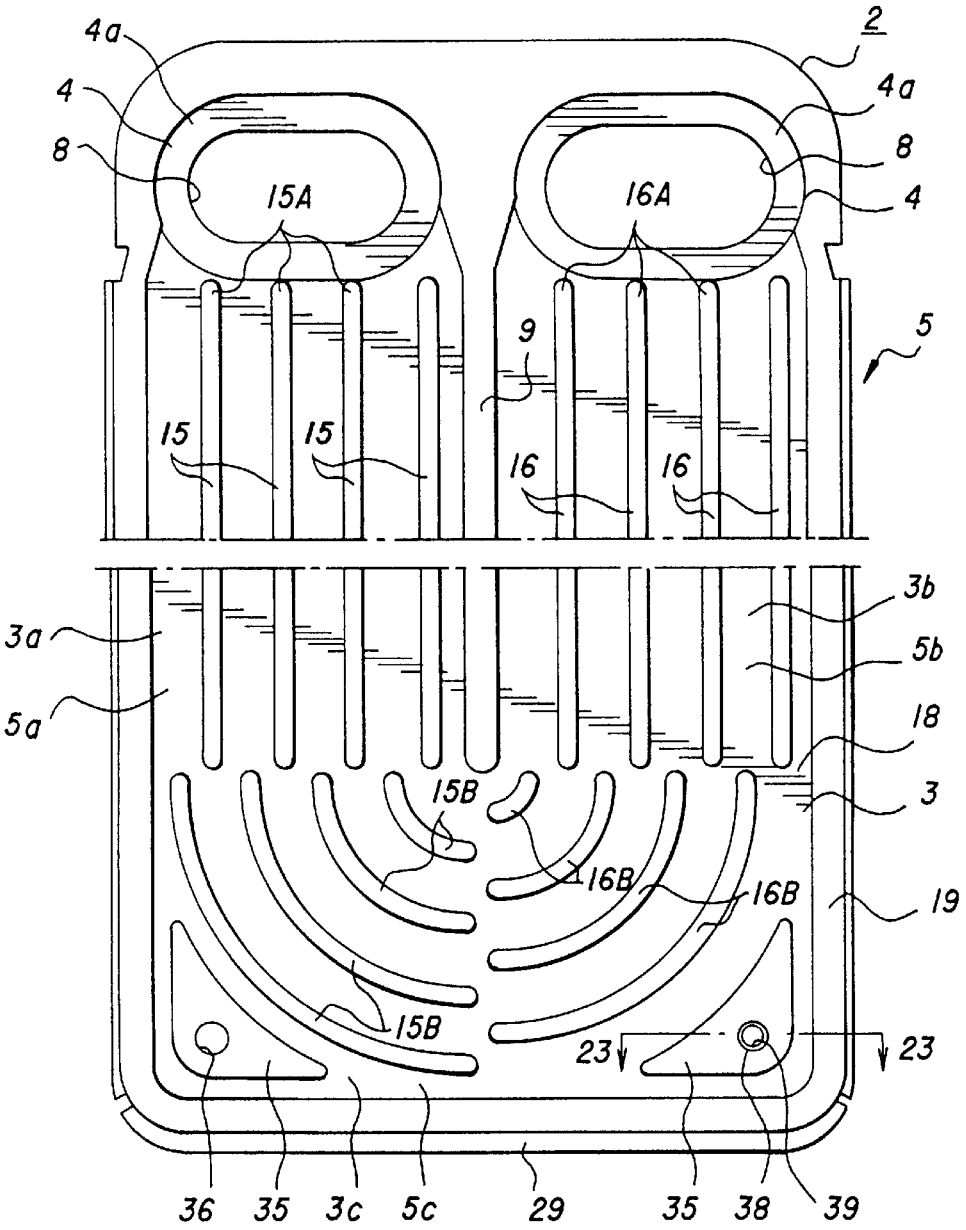
FIG. 22 is an enlarged fragmentary front view partly broken away and showing a modified plate for use in the heat exchanger.
Figure 23:
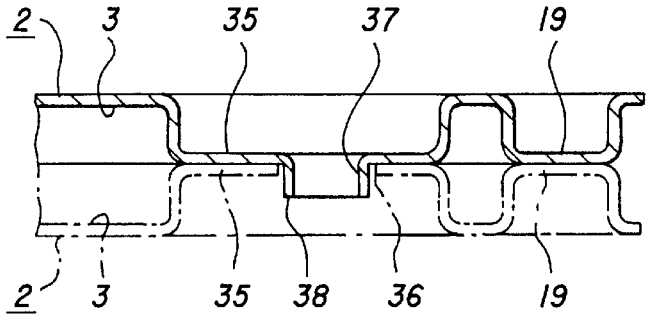
FIG. 23 is a view in section taken along the line 23—23 in FIG. 22.

FIGS. 22 and 23 shows a modified plate 2 for use in the evaporator 1 according to the sixth embodiment. With this modification, the ridges 15, 16 of the channel recess 3 of the plate 2 are separated into straight portions 15A, 16A and quarter circular-arc portions 15B, 16B, respectively, with the upper ends of the arc portions 15B, 16B displaced from the lower ends of the straight portions 15A, 16A by one-half of the ridge pitch.

Such modified plates 2, 2 are fitted together with their recesses 3, 3, as well as the recesses 4, 4, opposed to each other, the central partition ridges 9, 9 opposed to each other, as well as the peripheral edge portions 19, 19 of the plates, are butted against and joined to each other, and the independent straight portions 15A, 16A and the quarter circular-arc portions 15B, 16B of the ridges 15, 16 are joined at their top ends to the bottom wall 18 of channel recess 3 of the plate 2 opposed thereto.

Consequently, nine divided parallel U-shaped refrigerant passages are formed in the U-shaped refrigerant channel of the resulting flat tube 5 as in the case of the sixth embodiment.

With the modification, the front and rear corners of the lower end of the plate 2 are provided with generally triangular front and rear reinforcing projections 35, 35, respectively, which have the same height as the plate peripheral edge portion 19. As shown in FIGS. 22 and 23, a bore 39 defined by an annular wall 38 is formed by burring in one of the projections 35, and the other projection 35 is formed with a hole 36 for the annular wall 38 to fit in.

Accordingly when two plates 2, 2 are fitted and joined to each other, the annular wall 38 of the projection 35 of one of the plates is fitted into the hole 36 of the projection 35 of the other plate, whereby the adjacent plates 2, 2 can be accurately positioned relative to each other. This eliminates the need to crimp the peripheral edge portion of the plate 2 as conventionally done, making the plates accurately settable for brazing and positionable relative to each other within the furnace and obviating brazing faults and faults in the internal circuit due to positioning errors. In the front and rear headers 7, 6, and annular wall 26 around the refrigerant opening 8 is fitted into the opening 8 in the plate 2 opposed thereto. Thus, these fitting means prevent errors in positioning the plates 2 of the whole evaporator 1.

The ridges 15, 16 provided on the plate 2 according to the foregoing sixth embodiment or modification are not limited to those shown in shape but can be modified variously insofar as parallel U-shaped divided refrigerant passages can be formed the assembly of the adjacent plates 2, 2.

With the plates 2 of the sixth embodiment and the modification, the ridges 15, 16 are so disposed as to be alternately arranged in the assembly of adjacent plates 2, 2, and the U-shaped passages of the resulting flat tube 5 are arranged in the front and rear portions of the channel symmetrically as a whole, so that the number of ridges 15, 16 on the plate 2 can be smaller. This makes the plate 2 simple in configuration, easy to shape and less costly to manufacture, The ridges 15, 16 in the channel recess 3 of each plate 2 are joined at their top ends to the bottom wall 18 of recess 3 of the plate 2 opposed thereto. This affords an increased joint area, produces joints of line contact instead of spot-to-spot contact and leads to enhanced pressure resistant strength.

Figure 17:
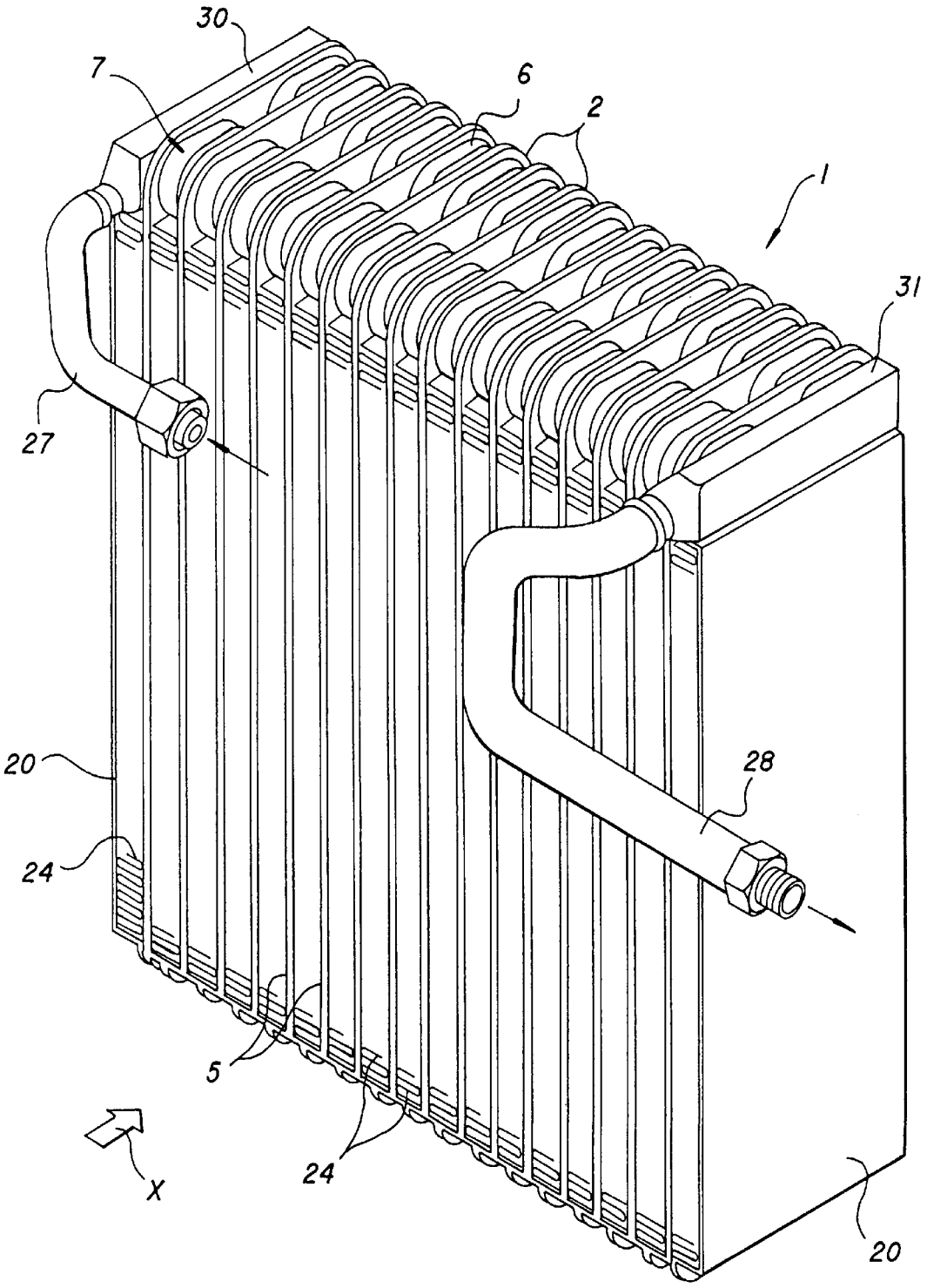
FIG. 17 is a schematic perspective view of a heat exchanger as a sixth embodiment of the invention.
Figure 18:
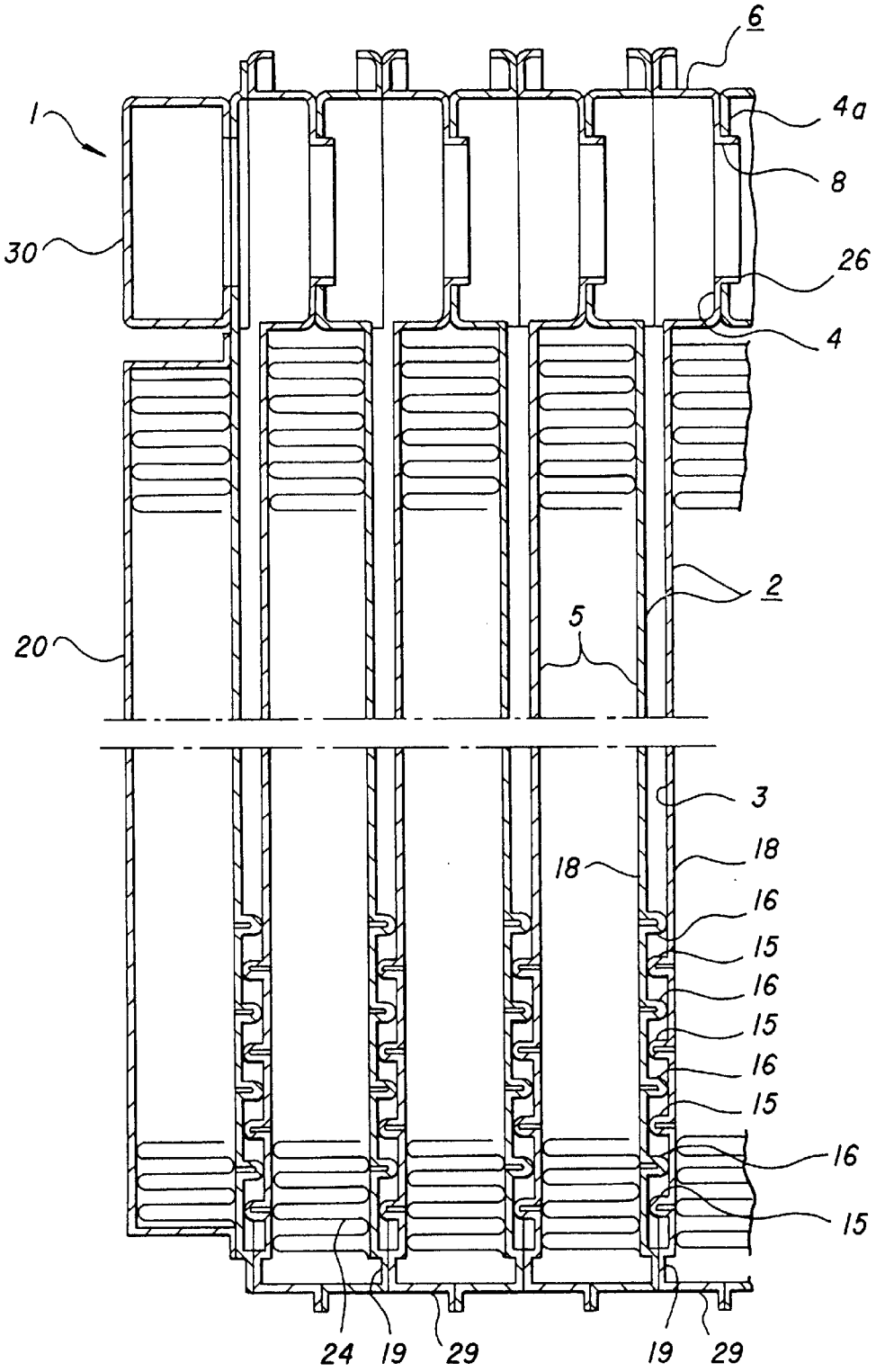
FIG. 18 is a view in vertical section of the heat exchanger.
Figure 25:
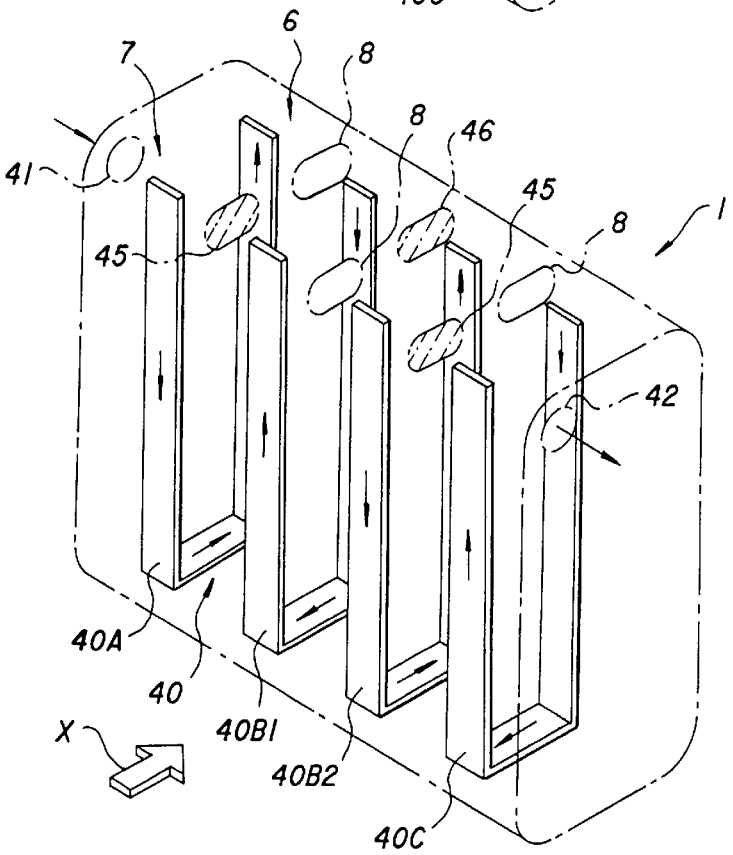
FIG. 25 is a perspective view schematically showing the refrigerant passage of a heat exchanger as a seventh embodiment of the invention.

FIG. 25 shows a seventh embodiment of the invention, i.e., another layered evaporator 1, which has the same appearance as the one shown in FIG. 17.

The evaporator 1 of the seventh embodiment has a refrigerant inlet 41 at the left end of the front header 7, and a refrigerant outlet 42 at the right end of the header. Partitions 45 are provided in the front header 7 at a position rightwardly away from its left end by a distance corresponding to about ¼ of the header length, and at a position leftwardly away from its right end by the same distance. A partition 46 is disposed in the rear header 6 at midportion thereof. The partition 45 of the front header 7 is formed by not forming a refrigerant passing opening 8 in the recess bottom wall 4*a* of the plate 2 concerned. The rear header partition 46 is similarly formed by not forming like opening 8.

A refrigerant inlet pipe 30 has an opening corresponding to the inlet 41, and a refrigerant outlet pipe 31 has an opening corresponding to the outlet 42. Consequently formed is a zigzag refrigerant passage 40 which is divided into an inlet passageway 40A, outlet passageway 40C and intermediate passageway 40B1, 40B2 positioned between the two passageways 40A, 40C, namely, an even number of passageways 40A, 40B1, 40B2, 40C, the flow of refrigerant through the outlet passageway 40C being countercurrent against the flow of air.

The refrigerant admitted from the inlet 41 is turned by the leftward front header partition 45 and flows through the inlet passageway 40A concurrently with the flow of air, is turned by the rear header partition 46 and flows through the first intermediate passageway 40B1 countercurrently against the flow of air, is turned by the rightward front header partition 45 and flows through the second intermediate passageway 40B2 concurrently with the flow of air, passes through the outlet passageway 40C countercurrently against the air flow, and is discharged via the outlet 42.

Figure 26:
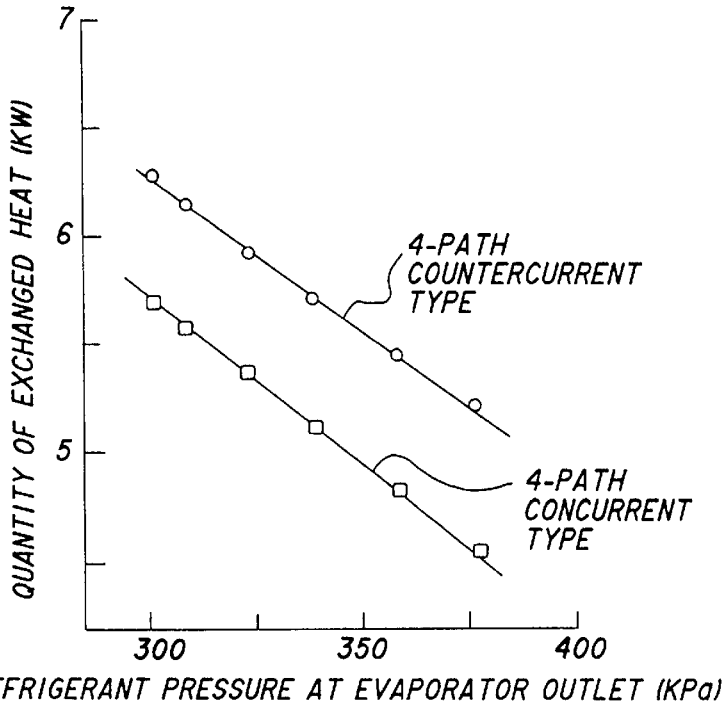
FIG. 26 is a graph showing the heat exchange efficiency of the heat exchanger.

The layered evaporator of the seventh embodiment (referred to as the "4-path counter current type") was compared with a comparative layered evaporator (referred to as the "4-path concurrent type") which differed from the former only in that the flow of refrigerator through the outlet passageway was concurrent with the flow of air. FIG. 26 is a graph showing the result.

The graph shows that the evaporator 1 of the 4-path countercurrent type embodying the invention is always greater than the comparative evaporator of the 4-path concurrent type in the quantity of exchanged heat regardless of the refrigerant pressure at the outlet, achieving an improvement of about 10% in the quantity of exchanged heat over the comparative evaporator.

Although not illustrated in the graph, the layered evaporator of the first embodiment, i.e., of the 3-path countercurrent type, and a modification thereof, i.e. a layered evaporator of the 5-path countercurrent type, achieved an improvement of about 10 to 15% in the quantity of exchanged heat over comparative evaporators of the 3-path concurrent type and 5-path concurrent type.

The partitions 45 in the front header 7 of the seventh embodiment need not always be disposed at a distance away from the right or left end by exactly ¼ of the header length, while the position of the partition 46 in the rear header 6 is not limited exactly to the midportion. These partitions are suitably shiftable rightward or leftward in view of the heat exchange efficiency.

Although the seventh embodiment has four passageways, partitions 45, 46, five in total number, may be disposed alternately in the front header 7 and rear header 6, i.e., three on the front side and two on the rear side, to form six passageways including an outlet passageway wherein the refrigerant flow is countercurrret against the air flow. Alternatively, only one partition 45 can be disposed in the front header 7 to form two passageways, one of which is a countercurrent outlet passageway against the air flow.

Figure 28:
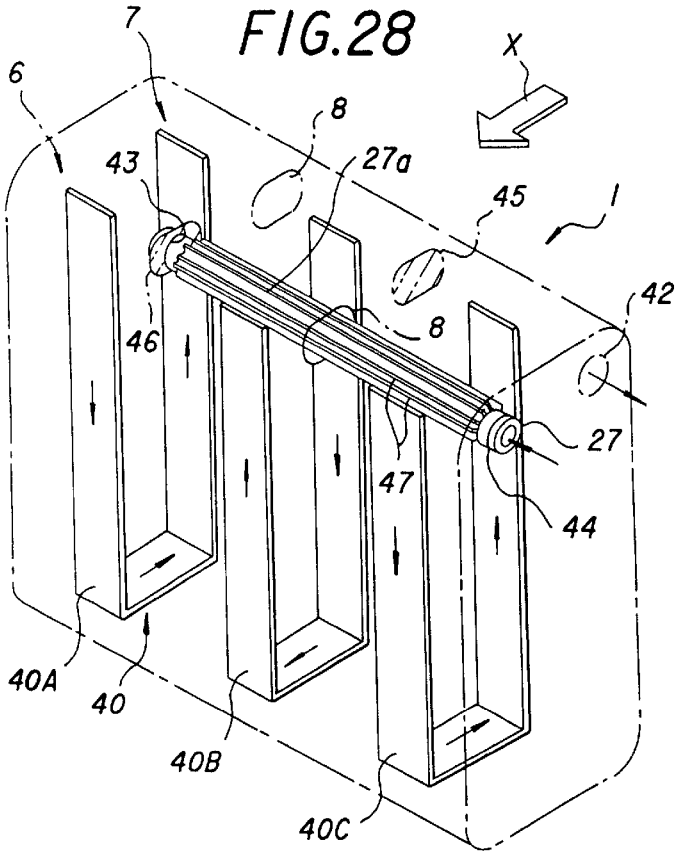
FIG. 28 is a perspectives view schematically showing the refrigerant passage of the heat exchanger.
Figure 29:
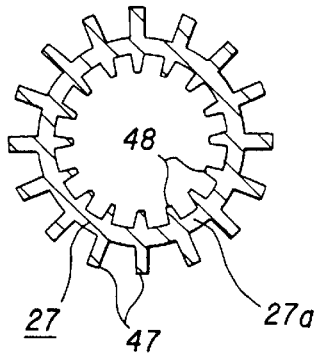
FIG. 29 is a cross sectional view showing a refrigerant feed pipe for use in the heat exchanger.
Figure 27:
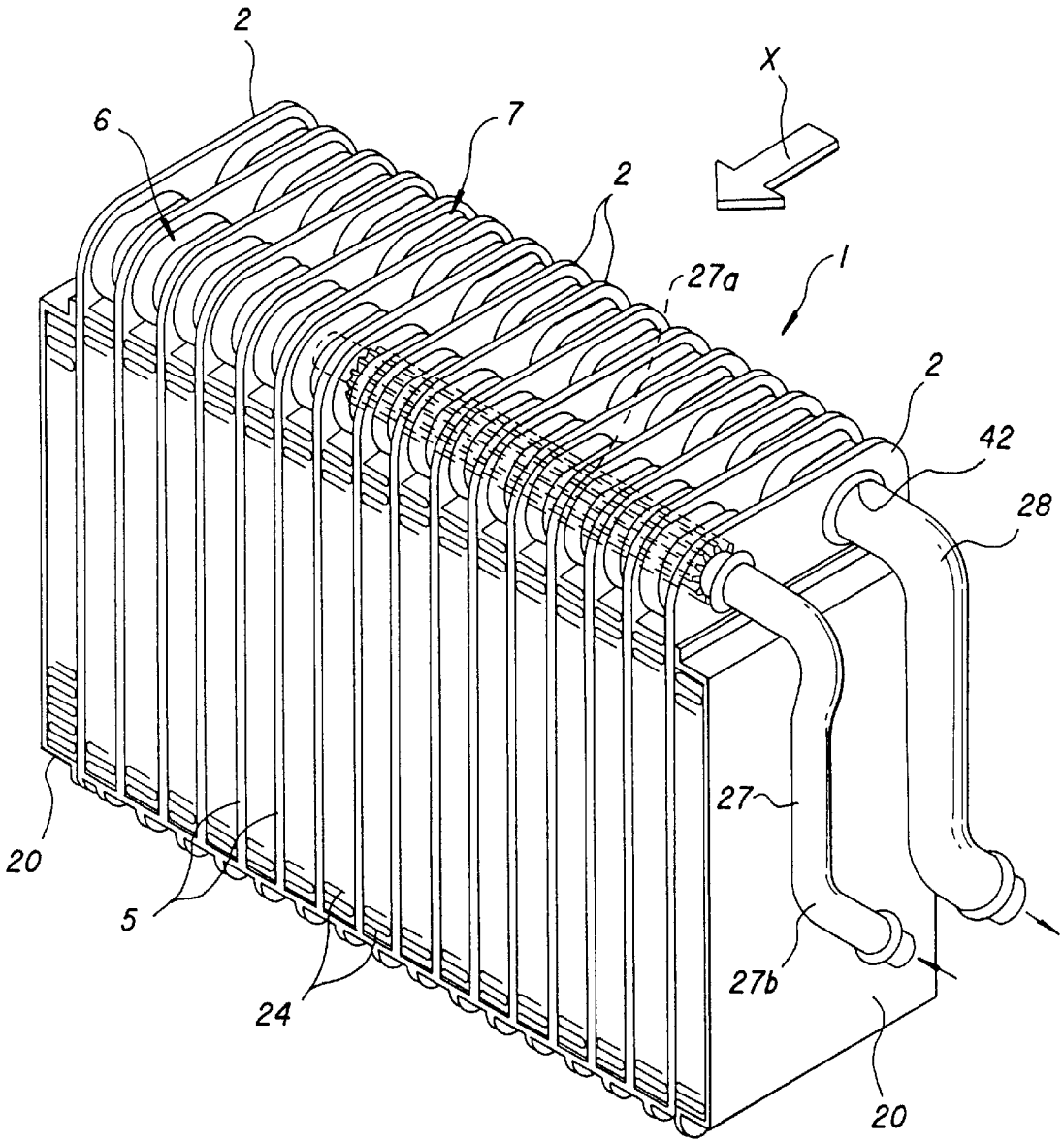
FIG. 27 is a schematic perspective view of a heat exchanger as an eighth embodiment of the invention.

FIGS. 27 to 29 show an eighth embodiment of the invention.

The illustrated layered evaporator 1 has a refrigerant outlet 42 at the left end of the front header 7, and a refrigerant discharge pipe 28 connected to the outlet 42. The rear header 6 has at its left end a pipe hole 44, through which a refrigerant feed pipe 27 is inserted. The feed pipe 27 comprises an inner pipe portion 27*a* extending rightward into the rear header 6 and an outer pipe portion 27*b* in parallel to the discharge pipe 28 and disposed outside the rear header 6.

As shown in FIG. 28, a partition 46 is provided in the rear header 6 at a position leftwardly away from the right end of the header 6 by a distance corresponding to about ⅓ of the header length. The front header 7 has a partition 45 at a position rightwardly away from its left end by a distance equal to about ⅓ of the header length. The rear header partition 46 is formed with a socket hole 43. The inner pipe portion 27*a* of the feed pipe 27 is inserted into the rear header 6 with a refrigerant passing clearance left in refrigerant passing openings 8 around the pipe portion 27*a*, and the pipe end is inverted in a socket 43 of the partition 46 of the rear header 6.

The arrangement described divides the rear header 6 into a first rear header compartment extending from the partition 46 to the right end, plate 2, and a second rear header compartment from the left end plate 2 to the partition 46. The front header 7 is similarly divided into a first front header compartment extending from the partition 45 to the right end plate 2, and a second front header compartment from the left end plate 2 to the partition 45.

Now suppose the evaporator 1 has 15 flat tubes. The first rear header compartment from the rear header partition 46 to the right end plate 2 corresponds to 5 flat tubes 5, and the second rear header compartment from the left end plate 2 to the partition 46 to 10 flat tubes 5. On the other hand, the first front header compartment from the front header partition 45 to the right end plate 2 corresponds to 10 flat tubes 5, and the second front header compartment from the left end plate 2 to the partition 45 to 5 flat tubes 5.

The interior of the evaporator 1 in its entirety is divided into three passageways 40A, 40B, 40C, i.e. , a countercurrent inlet passageway 40A against the flow of air a similarly countercurrent outlet passageway 40C against the flow of air, and an intermediate passageway 40B which is positioned between the two passageways 40A, 40C and wherein the refrigerant flows concurrently with the air flow.

The inlet passageway 40A comprises the first rear header compartment, for example 5 flat tubes corresponding thereto and the right half of the first front header compartment. The outlet passageway 40C comprises the second front header compartment, 5 flat tubes 5 corresponding thereto and the left half of the second rear header compartment. The intermediate passageway 40B between 40A, 40C comprises the left of the first front header compartment, 5 flat tubes 5 corresponding thereto and the right half of the second rear header compartment.

The partitions 45, 46 of the front and rear headers 7, 6 are each formed by not forming the refrigerant passing opening 8 in the header recess bottom wall 4*a* of the plate 2 concerned.

Now, the refrigerant is admitted into the first rear header compartment of the inlet passageway 40A from the forward end of inner pipe portion 27*a* of the refrigerant feed pipe 27. The refrigerant is turned by the right end plate 2 and flows into the corresponding 5 flat tubes 5 and the right half of the first front header compartment. The refrigerant then flows through the opening 8 into the left half of the first front header compartment of the intermediate passageway 40B, is turned by the partition 45 and flows into the corresponding 5 flat tubes 5 and the right half of the second front header compartment. Finally, the refrigerant passes through the opening 8 into the second front header compartment of the outlet passageway 40C which is countercurrent to the air flow, is turned by the left end plate 2, flows into the corresponding 5 flat tubes 5 and the second rear header compartment and is discharged from the outlet 42 to the outside via the discharge pipe 28.

The inner pipe portion 27*a* of the feed pipe 27, except for its opposite ends, is internally and externally provided with parallel fins 47, 48 extending longitudinally of the pipe portion 27*a* as shown in FIG. 29. Such parallel fins may be provided only on the inner or outer periphery of the pipe 27.

The forward end of the inner pipe portion 27*a* of the feed pipe 27 is secured by brazing to the peripheral edge of the socket 43 of the rear header partition 46.

With the layered evaporators 1 of the sixth to eighth embodiments described, the outlet passageway 40C achieves a higher heat exchange efficiency when countercurrent against the direction X of flow of air than when concurrent therewith for the following reason.

The refrigerant flows into the evaporator 1 in vapor and gas two phases, gradually evaporates within the flat tubes 5, and is discharged as superheated after evaporation for the prevention of return of liquid to the compressor.

The refrigerant is completely in the form of a gas in the superheat portion, so that the heat transfer coefficient of the superheat portion is as low as about 1/10 of that of the evaporation portion, and the superheat portion can be smaller in the entire layered evaporator 1. This permits provision of larger evaporation portion for an improved efficiency. In the rear half of the outlet passageway 40C wherein the refrigerant is in a superheated state and which is of the countercurrent type, the air is subjected to heat exchange first with the superheated refrigerant and thereafter with the refrigerant as evaporated in the usual state. In the case of the concurrent type, the air is subjected to heat exchange with the refrigerant in the usual evaporated state and then with superheated refrigerant.

Now, suppose the temperature difference between the refrigerant and air is ΔT, the overall heat transfer coefficient between the refrigerant and air is K, and the area of heat transfer between the refrigerant and air is A. The quantity Q of heat to be exchanged by the superheat portion is expressed by the following equation.

$$Q=\Delta T\times K\times A$$

On the other hand, if the quantity of superheat $\Delta T_{sh}$ is determined, the quantity $Q_{sh}$ of heat required for exchange at the superheat portion is expressed by the following equation wherein $C_p$ is specific heat.

$$Q_{sh}=C_p\times\Delta T_{sh}$$

Assuming that $Q_{sh}$ is definite, ΔT is greater when the outlet passageway 40C is countercurrent than when it is concurrent, so that the above equations indicate that the area of heat transfer A can be smaller. Thus, the superheat portion in the entire evaporator 1 can be diminished to attain an improved efficiency.

The improved efficiency is available by determining the construction of the refrigerant passage with consideration given to the direction of flow of air which has not been considered in any way. Accordingly, the improvement involves no conflicting factor.

Figure 30:
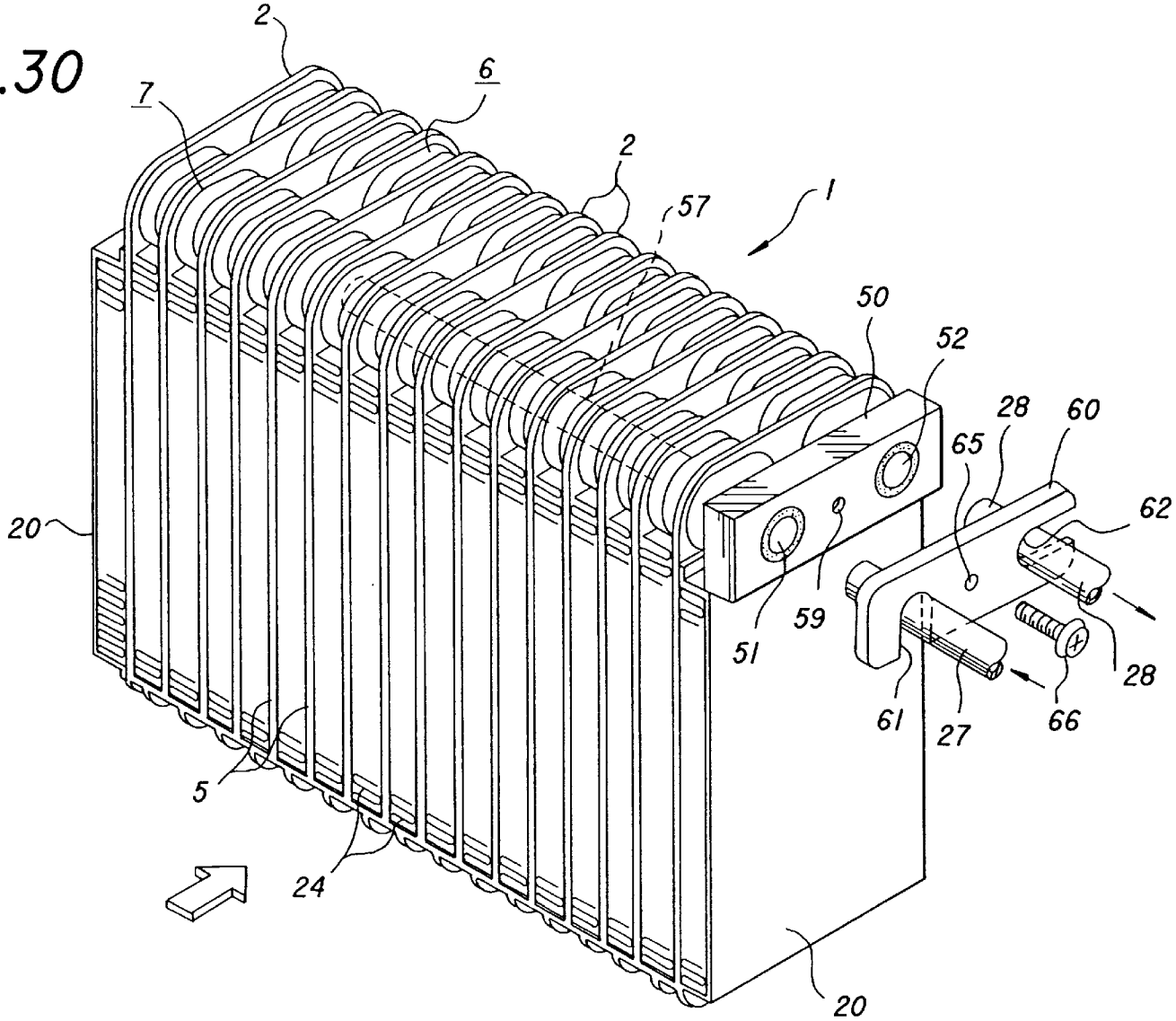
FIG. 30 is a schematic perspective view of a heat exchanger as a ninth embodiment of the invention, a refrigerant feed pipe and a refrigerant discharge pipe being also shown.
Figure 31:
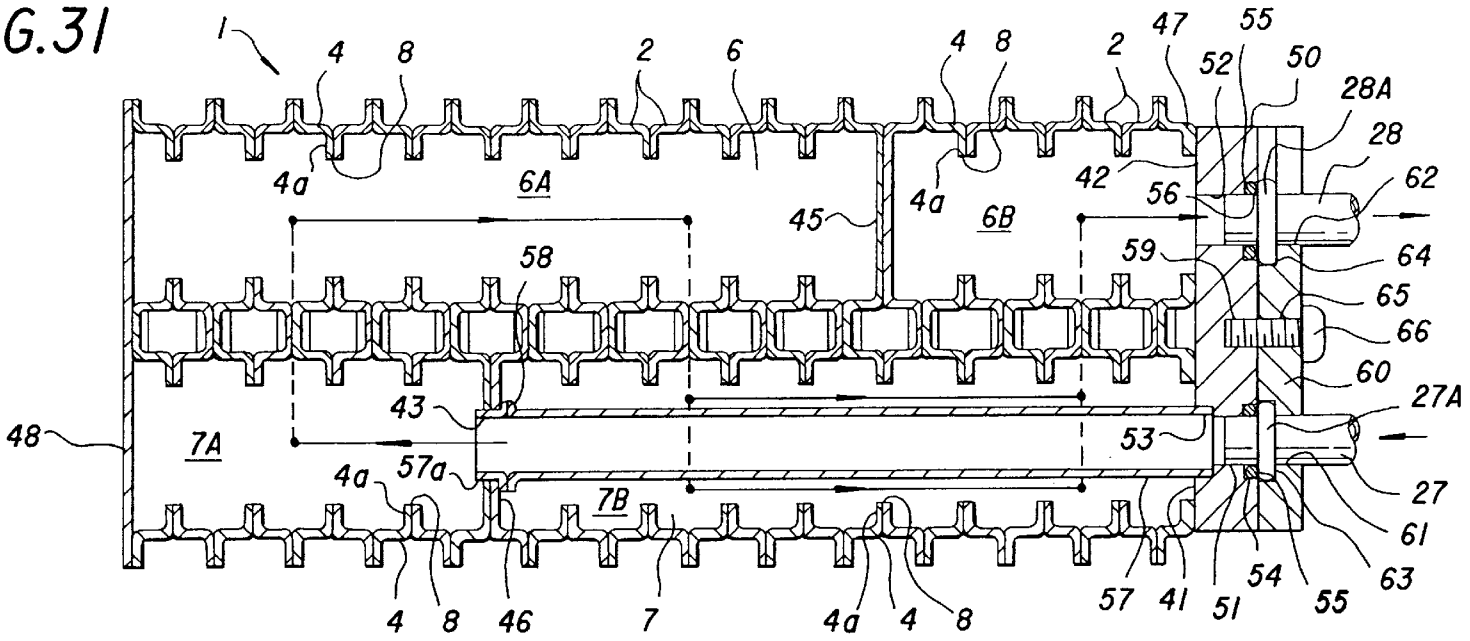
FIG. 31 is an enlarged view in horizontal section of a header portion of the heat exchanger.

FIGS. 30 and 31 show a ninth embodiment of the invention.

With reference to these drawings, the illustrated layered evaporator 1 has a pipe connecting block 50 formed with a refrigerant feed bore 51 and a refrigerant discharge bore 52 in communication with a refrigerant inlet 41 and a refrigerant outlet 42, respectively; a refrigerant feed pipe 27 and refrigerant discharge pipe 28 which are connected to the inlet 41 and the outlet 42 by the block 50; and a platelike mount member 60 for attaching the pipes 27, 28 to the pipe connecting block 50.

The block 50 is secured to the evaporator 1 with the downstream end of its; feed bore 51 opposed to the inlet 41 and with the upstream end of the discharge bore 52 opposed to the outlet 42.

The feed pipe 27 and discharge pipe 28 have retaining protuberances 27A, 28A formed by beading and each positioned close to its connected end.

The mount member 60 is formed with a U-shaped cutout 61 opened downward for the feed pipe 27 to fit in, and a U-shaped cutout 62 opened rearward for the discharge pipe 28 to fit in.

The inner periphery of the cut out 61 (62) is engageable with the retaining protuberance 27A (28A) of the pipe 27 (28). A portion of the pipe 27 (28) on one side of the protuberance 27A (28A) opposite to the connected pipe end is inserted in the cutout 61 (62) of the mount member 60. The connected end of the feed pipe 27 is inserted into the feed bore 51 in the connecting block 50 from the bore upstream end, and the connected end of the discharge pipe 28 is inserted into the discharge bore 52 in the block 50 from the bore downstream end. The mount member 60 is fastened to the outer side of tire block 50 with a screw 66. In this way, the two pipes 27, 28 are connected to the feed inlet 41 and discharge outlet 42 with their retaining protuberance 27A, 28A held between the mount member 60 and the connecting block 50.

The evaporator 1 has a right end plate 47, which is provided with the discharge outlet 42 communicating with a rear header 6, and the feed inlet 41 in communication with a front header 7.

The front header 7 has a partition 46 closer to its left end and formed with a hole 43 for inserting the forward end 57*a* of an inner pipe 57. A retaining protuberance 58 is formed by beading on the inner pipe 57 at a position close to its forward end.

The inner pipe end 57*a* is inserted through the hole 43 in the partition 46. The right end of the inner pipe 57 is inserted in an annular stepped portion formed in the block 50 around the downstream end of the feed bore 51. These pipe ends are secured by brazing. The left ends of the front and rear headers 7, 6 are closed with a plate 48.

Annular stepped portions 54, 56 are formed in the outer side of the connecting block 50 around the bores 51 and 52, respectively. An O-ring 55 is fitted in each of the stepped portions 54, 55.

The feed pipe 27 is fitted in the U-shaped cutout 51 of the mount member 60 from below. The discharge pipe 28 is, fitted in the cutout 62 from behind.

The block 50 is centrally formed with a screw bore 59 for the screw 66 to be screwed in. The mount member 60 is centrally formed with a hole 65 corresponding to the bore 59. The mount member 60 is attached to the outer side of the block 50 by driving the screw 66 into the bore 59 of the block 50 through the hole 65 in the mount member 60.

The front and rear headers 7, 6 are divided by the partitions 45, 46 at required portions into two header compartments 7A, 7B and two header compartments 6A, 6B, respectively.

These header compartments 7A, 7B, 6A, 6B and flat tubes 5 form a zigzag refrigerant passage which extends, as indicated by arrows in FIG. 31, from the first header compartment 7A at the left of the front header 7, via parallel flat tubes 5 at the left, left intermediate header compartment 6A of the rear header 6, central parallel flat tubes 5, right intermediate header compartment 7B of the front header 7 and parallel flat tubes 5 at the right, to right final header compartment 6B of the rear header 6.

Figure 32:
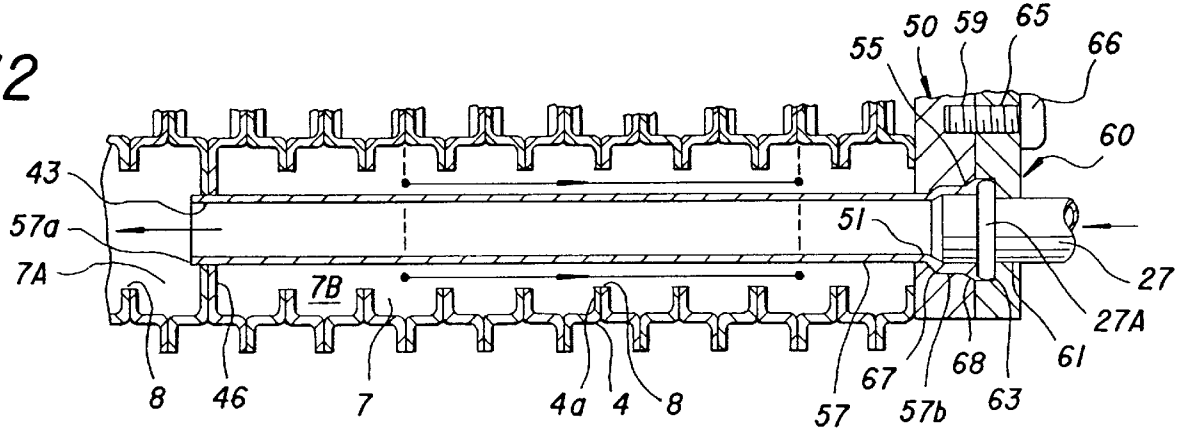
FIG. 32 is an enlarged fragmentary view in horizontal section of a header portion of a heat exchanger as a tenth embodiment of the invention.

FIG. 32 shows a tenth embodiment of the invention, which differs from the above ninth embodiment with respect to the following. The right end portion of the inner pipe 57 is enlarged by flaring into a large-diameter portion 57*b*, while the pipe connecting block 50 is formed around the feed bore 51 with a stepped portion 67 engageable with the large-diameter portion 57*b* of the inner pipe 57, and a stepped portion 68 for accommodating an O-ring 55.

The large right end of the inner pipe 57 is fitted in the block 50 in engagement with the stepped portion 57. This eliminates the need to provide the retaining protuberance 58 on the pipe 57 toward its forward end.

According to the ninth and tenth embodiments, the refrigerant feed pipe 27 and discharge pipe 28 are removably connected to the evaporator 1 by the pipe connecting block 50 and mount member 60, so that the evaporator can be transported or stored with the two pipes 27, 28 removed. This greatly reduces the space needed. Different pipes 27, 28 shaped in conformity with the conditions for use can be attached to the same type of evaporators 1. This results in the advantage of obviating the need to prepare different kinds of evaporators by attaching to evaporators of the same type such pipes of different shapes suited to use.

Although the feed pipe 27 and discharge pipe 28 are both attached by one mount member 60 according to the ninth and tenth embodiments, the mount member may be divided into two segments for individually attaching the pipes 27, 28.

The layered beat exchangers of the invention are useful not only as motor vehicle evaporators according to the foregoing embodiments but also for oil coolers, after coolers, radiators and other uses.

What is claimed is:

1. A layered heat exchanger comprising:

a plurality of pairs of generally rectangular adjacent plates with each plate of said pairs of plates having two straight portions separated by a turn portion, wherein said turn portion includes at least one fluid mixing means for causing fluid particles in one flow path to move to an adjacent flow path, said at least one fluid mixing means having a plurality of short projections and at least one rectifying means for dually functioning to cause said fluid particles in said one flow path to remain in a same said one flow path and to cause said fluid particles to flow more rapidly through said turn portion so as to prevent stagnation, uneven flow and reduced efficiency, said at least one rectifying means having a plurality of somewhat parallel long projections along a flow of a fluid refrigerant made up of said fluid particles that are flowing in a flow direction through said heat exchanger and wherein each of said straight portions has a plurality of generally U-shaped channel recesses formed in one side thereof so that each said plate of each of said pairs of plates has a side with both generally flat and concave surfaces and a side with both generally flat and convex surfaces so that a first plate of each of said pairs of plates is joined to a second plate of each of said pairs of plates with said convex surfaces of said first plate of said pairs of plates positioned to face said convex surfaces of said second plate of said pairs of plates and to abut a flat surface of said second plate of said pairs of plates to thereby form a plurality of juxtaposed flattened tubes with each tube defining discrete said flow paths through which said fluid particles travel without mixing with other fluid particles in adjacent flow paths of each of said straight portions, said pairs of plates being arranged in layers having a first pair of plates, a last pair of plates and a plurality of pairs of plates therebetween to form said heat exchanger;

a front and a rear header formed from a plurality of header recesses such that each of said header recesses are continuous respectively from said first pair of plates to said last pair of plates with each header recess having an opening through which said fluid refrigerant passes, wherein said front and rear headers each communicate with an end of said flattened tubes in order for said fluid refrigerant to flow from an inlet through said headers to an outlet of said flow paths of said flattened tubes;

wherein said turn portion has said rectifying means located centrally thereof and said fluid mixing means located at each of a front and a rear side of said rectifying means with respect to said direction of flow of said fluid particle; and wherein said rectifying means comprises rearwardly downwardly inclined parallel projections, horizontal parallel projections and forwardly downwardly inclined parallel projections, all of which permit said fluid refrigerant to flow from said rear channel portion of said turn portion through said central channel portion containing said rectifying means and into said front channel portion of said turn portion more rapidly.

2. The layered heat exchanger as defined in claim 1, wherein said projections provided in said turn portion have a height equal to the depth of said generally U-shaped channel recesses, each pair of adjacent plates having a top end of said projections butted against and joined to a top end of an opposed projection, to form said fluid mixing means by said short projections and said rectifying means by said parallel long projections, respectively.

3. The layered heat exchanger as defined in claim 1 wherein said projections provided in the turn portion have a height twice the depth of said generally U-shaped channel recesses, each pair of adjacent plates having said projections with said height arranged alternately in positions different from each other, said projections each having a top end butting against and joined to a bottom wall of said turn portion of the plate opposed thereto, to form said fluid mixing means by said short projections and said rectifying means by said parallel long projections, respectively.

4. The layered heat exchanger as defined in claim 1, wherein said turn portion has a central part with said short and long projections, each of said short and long projections having a height equal to a depth of said generally U-shaped channel recesses, each pair of adjacent plates having said short and long projections with said height arranged alternately in positions different from each other, and said short and long projections in front and rear sides adjoining said central part each having a top end butted against and joined to a bottom wall of said turn portion of said plate opposed thereto, to form said fluid mixing means.

5. The layered heat exchanger as defined in claim 1, wherein said generally U-shaped channel recess of each plate has front and rear straight channel forming portions provided with vertically elongated rectifying ridges having a height twice to a depth of said recess, each pair of adjacent plates as fitted together having said rectifying ridges arranged alternately in different positions, said rectifying ridges each having an end joined to a bottom wall of said straight channel forming portion of said plate opposed thereto.

6. The layered heat exchanger as defined in claim 1, wherein each pair of adjacent plates has a plate peripheral edge portion and a vertically elongated ridge partition which are joined to each other end-to-end.

* * * * *